US008002052B2

(12) United States Patent
Stevens et al.

(10) Patent No.: US 8,002,052 B2
(45) **Date of Patent: *Aug. 23, 2011**

(54) PARTICLE-MATRIX COMPOSITE DRILL BITS WITH HARDFACING

(75) Inventors: John H. Stevens, Spring, TX (US); James Leslie Overstreet, Tomball, TX (US); Kenneth E. Gilmore, Cleveland, TX (US); Jeremy K. Morgan, Midway, TX (US)

(73) Assignee: Baker Hughes Incorporated, Houston, TX (US)

( * ) Notice: Subject to any disclaimer, the term of this patent is extended or adjusted under 35 U.S.C. 154(b) by 157 days.

This patent is subject to a terminal disclaimer.

(21) Appl. No.: 11/823,800

(22) Filed: Jun. 27, 2007

(65) Prior Publication Data

US 2008/0029310 A1 Feb. 7, 2008

Related U.S. Application Data

(63) Continuation-in-part of application No. 11/513,677, filed on Aug. 30, 2006, and a continuation-in-part of application No. 11/272,439, filed on Nov. 10, 2005, and a continuation-in-part of application No. 11/223,215, filed on Sep. 9, 2005.

(60) Provisional application No. 60/848,154, filed on Sep. 29, 2006.

(51) Int. Cl.
*E21B 10/54* (2006.01)

(52) U.S. Cl. ..... 175/374; 175/375

(58) Field of Classification Search ..... 175/374, 175/425

See application file for complete search history.

(56) References Cited

U.S. PATENT DOCUMENTS

| | | | |
|---|---|---|---|
| 2,033,594 | A | 9/1931 | Stoody |
| 2,407,642 | A | 9/1946 | Ashworth |
| 2,660,405 | A | 11/1953 | Scott et al. |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,961,312 | A | 11/1960 | Elbaum |
| 3,158,214 | A | 11/1964 | Wisler et al. |
| 3,260,579 | A | 7/1966 | Scales et al. |
| 3,368,881 | A | 2/1968 | Abkowitz et al. |
| 3,471,921 | A | 10/1969 | Feenstra |
| 3,660,050 | A | 5/1972 | Iler et al. |
| 3,757,879 | A | 9/1973 | Wilder et al. |

(Continued)

FOREIGN PATENT DOCUMENTS

AU 695583 2/1998

(Continued)

OTHER PUBLICATIONS

PCT International Search Report for PCT/US2007/021071, mailed Feb. 6, 2008.

(Continued)

*Primary Examiner* — William P Neuder
*Assistant Examiner* — Nicole A Coy
(74) *Attorney, Agent, or Firm* — TraskBritt

(57) ABSTRACT

A rotary drill bit includes a bit body substantially formed of a particle-matrix composite material having an exterior surface and an abrasive wear-resistant material disposed on at least a portion of the exterior surface of the bit body. Methods for applying an abrasive wear-resistant material to a surface of a drill bit are also provided.

8 Claims, 18 Drawing Sheets

U.S. PATENT DOCUMENTS

| | | | |
|---|---|---|---|
| 3,768,984 | A | 10/1973 | Foster, Jr. |
| 3,790,353 | A | 2/1974 | Jackson et al. |
| 3,800,891 | A | 4/1974 | White et al. |
| 3,942,954 | A | 3/1976 | Frehn |
| 3,987,859 | A | 10/1976 | Lichte |
| 3,989,554 | A | 11/1976 | Wisler |
| 4,017,480 | A | 4/1977 | Baum |
| 4,043,611 | A | 8/1977 | Wallace |
| 4,047,828 | A | 9/1977 | Makely |
| 4,059,217 | A | 11/1977 | Woodward |
| 4,094,709 | A | 6/1978 | Rozmus |
| 4,128,136 | A | 12/1978 | Generoux |
| 4,173,457 | A | 11/1979 | Smith |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,243,727 | A | 1/1981 | Wisler et al. |
| 4,252,202 | A | 2/1981 | Purser, Sr. |
| 4,255,165 | A | 3/1981 | Dennis et al. |
| 4,262,761 | A | 4/1981 | Crow |
| 4,306,139 | A | 12/1981 | Shinozaki et al. |
| 4,341,557 | A | 7/1982 | Lizenby |
| 4,389,952 | A | 6/1983 | Dreier et al. |
| 4,398,952 | A | 8/1983 | Drake |
| 4,414,029 | A | 11/1983 | Newman et al. |
| 4,455,278 | A | 6/1984 | van Nederveen et al. |
| 4,499,048 | A | 2/1985 | Hanejko |
| 4,499,795 | A | 2/1985 | Radtke |
| 4,499,958 | A | 2/1985 | Radtke et al. |
| 4,526,748 | A | 7/1985 | Rozmus |
| 4,547,337 | A | 10/1985 | Rozmus |
| 4,552,232 | A | 11/1985 | Frear |
| 4,554,130 | A | 11/1985 | Ecer |
| 4,562,892 | A | 1/1986 | Ecer |
| 4,562,990 | A | 1/1986 | Rose |
| 4,579,713 | A | 4/1986 | Lueth |
| 4,596,694 | A | 6/1986 | Rozmus |
| 4,597,456 | A | 7/1986 | Ecer |
| 4,597,730 | A | 7/1986 | Rozmus |
| 4,611,673 | A | 9/1986 | Childers et al. |
| 4,630,692 | A | 12/1986 | Ecer |
| 4,630,693 | A | 12/1986 | Goodfellow |
| 4,656,002 | A | 4/1987 | Lizenby et al. |
| 4,666,797 | A | 5/1987 | Newman et al. |
| 4,667,756 | A | 5/1987 | King et al. |
| 4,674,802 | A | 6/1987 | McKenna et al. |
| 4,676,124 | A | 6/1987 | Fischer |
| 4,686,080 | A | 8/1987 | Hara et al. |
| 4,694,919 | A | 9/1987 | Barr |
| 4,726,432 | A | 2/1988 | Scott et al. |
| 4,743,515 | A | 5/1988 | Fischer et al. |
| 4,744,943 | A | 5/1988 | Timm |
| 4,762,028 | A | 8/1988 | Regan |
| 4,781,770 | A | 11/1988 | Kar |
| 4,809,903 | A | 3/1989 | Eylon et al. |
| 4,814,234 | A | 3/1989 | Bird |
| 4,836,307 | A | 6/1989 | Keshavan et al. |
| 4,838,366 | A | 6/1989 | Jones |
| 4,871,377 | A | 10/1989 | Frushour |
| 4,884,477 | A | 12/1989 | Smith et al. |
| 4,889,017 | A | 12/1989 | Fuller et al. |
| 4,919,013 | A | 4/1990 | Smith et al. |
| 4,923,512 | A | 5/1990 | Timm et al. |
| 4,938,991 | A | 7/1990 | Bird |
| 4,944,774 | A | 7/1990 | Keshavan et al. |
| 4,956,012 | A | 9/1990 | Jacobs et al. |
| 4,968,348 | A | 11/1990 | Abkowitz et al. |
| 5,000,273 | A | 3/1991 | Horton et al. |
| 5,010,225 | A | 4/1991 | Carlin |
| 5,030,598 | A | 7/1991 | Hsieh |
| 5,032,352 | A | 7/1991 | Meeks et al. |
| 5,038,640 | A | 8/1991 | Sullivan et al. |
| 5,049,450 | A | 9/1991 | Dorfman et al. |
| 5,051,112 | A | 9/1991 | Keshavan et al. |
| 5,089,182 | A | 2/1992 | Findeisen et al. |
| 5,090,491 | A | 2/1992 | Tibbits et al. |
| 5,101,692 | A | 4/1992 | Simpson |
| 5,150,636 | A | 9/1992 | Hill |
| 5,152,194 | A | 10/1992 | Keshavan et al. |
| 5,161,898 | A | 11/1992 | Drake |
| 5,186,267 | A | 2/1993 | White |
| 5,232,522 | A | 8/1993 | Doktycz et al. |
| 5,250,355 | A | 10/1993 | Newman et al. |
| 5,281,260 | A | 1/1994 | Kumar et al. |
| 5,286,685 | A | 2/1994 | Schoennahl et al. |
| 5,291,807 | A | 3/1994 | Vanderford et al. |
| 5,311,958 | A | 5/1994 | Isbell et al. |
| 5,328,763 | A | 7/1994 | Terry |
| 5,348,806 | A | 9/1994 | Kojo et al. |
| 5,373,907 | A | 12/1994 | Weaver |
| 5,433,280 | A | 7/1995 | Smith |
| 5,439,068 | A | 8/1995 | Huffstutler et al. |
| 5,443,337 | A | 8/1995 | Katayama |
| 5,479,997 | A | 1/1996 | Scott et al. |
| 5,482,670 | A | 1/1996 | Hong |
| 5,484,468 | A | 1/1996 | Ostlund et al. |
| 5,492,186 | A | 2/1996 | Overstreet et al. |
| 5,506,055 | A | 4/1996 | Dorfman et al. |
| 5,535,838 | A | 7/1996 | Keshavan et al. |
| 5,543,235 | A | 8/1996 | Mirchandani et al. |
| 5,544,550 | A | 8/1996 | Smith |
| 5,560,440 | A | 10/1996 | Tibbitts |
| 5,586,612 | A | 12/1996 | Isbell et al. |
| 5,593,474 | A | 1/1997 | Keshavan et al. |
| 5,611,251 | A | 3/1997 | Katayama |
| 5,612,264 | A | 3/1997 | Nilsson et al. |
| 5,641,251 | A | 6/1997 | Leins et al. |
| 5,641,921 | A | 6/1997 | Dennis et al. |
| 5,653,299 | A | 8/1997 | Sreshta et al. |
| 5,662,183 | A | 9/1997 | Fang |
| 5,663,512 | A | 9/1997 | Schader et al. |
| 5,666,864 | A | 9/1997 | Tibbitts |
| 5,677,042 | A | 10/1997 | Massa et al. |
| 5,679,445 | A | 10/1997 | Massa et al. |
| 5,697,046 | A | 12/1997 | Conley |
| 5,697,462 | A | 12/1997 | Grimes et al. |
| 5,732,783 | A | 3/1998 | Truax et al. |
| 5,733,649 | A | 3/1998 | Kelley et al. |
| 5,733,664 | A | 3/1998 | Kelley et al. |
| 5,740,872 | A | 4/1998 | Smith |
| 5,753,160 | A | 5/1998 | Takeuchi et al. |
| 5,755,298 | A | 5/1998 | Langford, Jr. et al. |
| 5,765,095 | A | 6/1998 | Flak et al. |
| 5,776,593 | A | 7/1998 | Massa et al. |
| 5,778,301 | A | 7/1998 | Hong |
| 5,789,686 | A | 8/1998 | Massa et al. |
| 5,791,422 | A | 8/1998 | Liang et al. |
| 5,791,423 | A | 8/1998 | Overstreet et al. |
| 5,792,403 | A | 8/1998 | Massa et al. |
| 5,806,934 | A | 9/1998 | Massa et al. |
| 5,830,256 | A | 11/1998 | Northrop et al. |
| 5,856,626 | A | 1/1999 | Fischer et al. |
| 5,865,571 | A | 2/1999 | Tankala et al. |
| 5,880,382 | A | 3/1999 | Fang et al. |
| 5,893,204 | A | 4/1999 | Symonds |
| 5,896,940 | A | 4/1999 | Pietrobelli et al. |
| 5,897,830 | A | 4/1999 | Abkowitz et al. |
| 5,904,212 | A | 5/1999 | Arfele |
| 5,921,330 | A | 7/1999 | Sue et al. |
| 5,924,502 | A | 7/1999 | Arfele et al. |
| 5,954,147 | A | 9/1999 | Overstreet et al. |
| 5,957,006 | A | 9/1999 | Smith |
| 5,963,775 | A * | 10/1999 | Fang ..... 419/36 |
| 5,967,248 | A | 10/1999 | Drake et al. |
| 5,980,602 | A | 11/1999 | Carden |
| 5,988,302 | A | 11/1999 | Sreshta et al. |
| 5,988,303 | A | 11/1999 | Arfele |
| 6,029,544 | A | 2/2000 | Katayama |
| 6,045,750 | A | 4/2000 | Drake et al. |
| 6,051,171 | A | 4/2000 | Takeuchi et al. |
| 6,063,333 | A | 5/2000 | Dennis |
| 6,068,070 | A | 5/2000 | Scott |
| 6,073,518 | A | 6/2000 | Chow et al. |
| 6,086,980 | A | 7/2000 | Foster et al. |
| 6,089,123 | A | 7/2000 | Chow et al. |
| 6,099,664 | A | 8/2000 | Davies et al. |

| | | | | |
|---|---|---|---|---|
| 6,124,564 | A | 9/2000 | Sue et al. | |
| 6,131,677 | A | 10/2000 | Arfele et al. | |
| 6,148,936 | A | 11/2000 | Evans et al. | |
| 6,196,338 | B1 | 3/2001 | Slaughter et al. | |
| 6,200,514 | B1 | 3/2001 | Meister | |
| 6,206,115 | B1 | 3/2001 | Overstreet et al. | |
| RE37,127 | E | 4/2001 | Schader et al. | |
| 6,209,420 | B1 | 4/2001 | Butcher et al. | |
| 6,214,134 | B1 | 4/2001 | Eylon et al. | |
| 6,214,287 | B1 | 4/2001 | Waldenstrom | |
| 6,220,117 | B1 | 4/2001 | Butcher | |
| 6,227,188 | B1 | 5/2001 | Tankala et al. | |
| 6,228,139 | B1 | 5/2001 | Oskarrson | |
| 6,234,261 | B1 * | 5/2001 | Evans et al. | 175/374 |
| 6,241,036 | B1 | 6/2001 | Lovato et al. | |
| 6,248,149 | B1 | 6/2001 | Massey et al. | |
| 6,254,658 | B1 | 7/2001 | Taniuchi et al. | |
| 6,287,360 | B1 | 9/2001 | Kembaiyan et al. | |
| 6,290,438 | B1 | 9/2001 | Papajewski | |
| 6,293,986 | B1 | 9/2001 | Rodiger et al. | |
| 6,348,110 | B1 | 2/2002 | Evans | |
| 6,349,780 | B1 * | 2/2002 | Beuershausen | 175/408 |
| 6,360,832 | B1 | 3/2002 | Overstreet et al. | |
| 6,375,706 | B2 | 4/2002 | Kembaiyan et al. | |
| 6,450,271 | B1 | 9/2002 | Tibbitts et al. | |
| 6,453,899 | B1 | 9/2002 | Tselesin | |
| 6,454,025 | B1 | 9/2002 | Runquist et al. | |
| 6,454,028 | B1 | 9/2002 | Evans | |
| 6,454,030 | B1 | 9/2002 | Findley et al. | |
| 6,458,471 | B2 | 10/2002 | Lovato et al. | |
| 6,474,425 | B1 | 11/2002 | Truax et al. | |
| 6,500,226 | B1 | 12/2002 | Dennis | |
| 6,511,265 | B1 | 1/2003 | Mirchandani et al. | |
| 6,568,491 | B1 | 5/2003 | Matthews, III et al. | |
| 6,575,350 | B2 | 6/2003 | Evans et al. | |
| 6,576,182 | B1 | 6/2003 | Ravagni et al. | |
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,615,936 | B1 | 9/2003 | Mourik et al. | |
| 6,651,756 | B1 | 11/2003 | Costo, Jr. et al. | |
| 6,655,481 | B2 | 12/2003 | Findley et al. | |
| 6,659,206 | B2 | 12/2003 | Liang et al. | |
| 6,663,688 | B2 | 12/2003 | Findeisen et al. | |
| 6,685,880 | B2 | 2/2004 | Engstrom et al. | |
| 6,725,952 | B2 | 4/2004 | Singh | |
| 6,742,608 | B2 | 6/2004 | Murdoch | |
| 6,742,611 | B1 | 6/2004 | Illerhaus et al. | |
| 6,756,009 | B2 | 6/2004 | Sim et al. | |
| 6,766,870 | B2 | 7/2004 | Overstreet | |
| 6,772,849 | B2 | 8/2004 | Oldham et al. | |
| 6,782,958 | B2 | 8/2004 | Liang et al. | |
| 6,849,231 | B2 | 2/2005 | Kojima et al. | |
| 6,861,612 | B2 | 3/2005 | Bolton et al. | |
| 6,918,942 | B2 | 7/2005 | Hatta et al. | |
| 6,948,403 | B2 | 9/2005 | Singh | |
| 7,044,243 | B2 | 5/2006 | Kembaiyan et al. | |
| 7,048,081 | B2 | 5/2006 | Smith et al. | |
| 7,240,746 | B2 | 7/2007 | Overstreet et al. | |
| 2001/0015290 | A1 | 8/2001 | Sue et al. | |
| 2001/0017224 | A1 | 8/2001 | Evans et al. | |
| 2002/0004105 | A1 | 1/2002 | Kunze et al. | |
| 2003/0010409 | A1 | 1/2003 | Kunze et al. | |
| 2004/0013558 | A1 | 1/2004 | Kondoh et al. | |
| 2004/0060742 | A1 | 4/2004 | Kembaiyan et al. | |
| 2004/0196638 | A1 | 10/2004 | Lee et al. | |
| 2004/0243241 | A1 | 12/2004 | Istephanous et al. | |
| 2004/0245022 | A1 | 12/2004 | Izaguirre et al. | |
| 2004/0245024 | A1 * | 12/2004 | Kembaiyan | 175/425 |
| 2005/0008524 | A1 | 1/2005 | Testani | |
| 2005/0072496 | A1 | 4/2005 | Hwang et al. | |
| 2005/0084407 | A1 | 4/2005 | Myrick | |
| 2005/0117984 | A1 | 6/2005 | Eason et al. | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |
| 2006/0185908 | A1 * | 8/2006 | Kembaiyan et al. | 175/425 |
| 2007/0042217 | A1 | 2/2007 | Fang et al. | |
| 2007/0056776 | A1 | 3/2007 | Overstreet | |
| 2007/0056777 | A1 | 3/2007 | Overstreet | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0163812 | A1 | 7/2007 | Overstreet et al. | |
| 2008/0053709 | A1 | 3/2008 | Lockstedt et al. | |
| 2008/0083568 | A1 | 4/2008 | Overstreet | |

FOREIGN PATENT DOCUMENTS

| | | | |
|---|---|---|---|
| CA | 2212197 | | 10/2000 |
| EP | 0 264 674 | A2 | 4/1988 |
| EP | 0 453 428 | A1 | 10/1991 |
| EP | 0 995 876 | A2 | 4/2000 |
| EP | 1 244 531 | B1 | 10/2002 |
| GB | 945227 | | 12/1963 |
| GB | 1 070039 | | 5/1967 |
| GB | 2 104 101 | A | 3/1983 |
| GB | 2203774 | A | 10/1988 |
| GB | 2 295 157 | A | 5/1996 |
| GB | 2352727 | A | 2/2001 |
| GB | 2 357 788 | A | 4/2001 |
| GB | 2 385 350 | A | 8/2003 |
| GB | 2 393 449 | A | 3/2004 |
| JP | 10 219385 | A | 8/1998 |
| WO | WO 03/049889 | A2 | 6/2003 |
| WO | WO 2004/053197 | A2 | 6/2004 |
| WO | WO 2006/099629 | A1 | 9/2006 |
| WO | 2007/030707 | A1 | 3/2007 |

OTHER PUBLICATIONS

Smith International, Inc., Smith Bits Product Catalog 2005-2006, p. 45.

"Boron Carbide Nozzles and Inserts," Seven Stars International webpage http://www.concentric.net/~ctkang/nozzle.shtml, printed Sep. 7, 2006.

"Heat Treating of Titanium and Titanium Alloys," Key to Metals website article, www.key-to-metals.com, (no date).

Alman, D.E., et al., "The Abrasive Wear of Sintered Titanium Matrix-Ceramic Particle Reinforced Composites," WEAR, 225-229 (1999), pp. 629-639.

Choe, Heeman, et al., "Effect of Tungsten Additions on the Mechanical Properties of Ti-6A1-4V," Material Science and Engineering, A 396 (2005), pp. 99-106, Elsevier.

Diamond Innovations, "Composite Diamond Coatings, Superhard Protection of Wear Parts New Coating and Service Parts from Diamond Innovations" brochure, 2004.

Gale, W.F, et al., Smithells Metals Reference Book, Eighth Edition, 2003, p. 2,117, Elsevier Butterworth Heinemann.

Miserez, A., et al. "Particle Reinforced Metals of High Ceramic Content," Material Science and Engineering A 387-389 (2004), pp. 822-831, Elsevier.

PCT International Search Report and Written Opinion of the International Searching Authority for PCT Counterpart Application No. PCT/US06/35010, dated Dec. 27, 2006 (10 pages).

PCT International Search Report and Written Opinion of the International Search Authority for PCT Counterpart Application No. PCT/US2006/043669, mailed Apr. 13, 2007.

PCT International Search Report and Written Opinion of the International Search Authority for PCT Counterpart Application No. PCT/US2006/043670, mailed Apr. 2, 2007.

Reed, James S., "Chapter 13: Particle Packing Characteristics," Principles of Ceramics Processing, Second Edition, John Wiley & Sons, Inc. (1995), pp. 215-227.

U.S. Appl. No. 60/566,063, filed Apr. 28, 2004, entitled "Body Materials for Earth Boring Bits" to Mirchandani et al.

U.S. Appl. No. 60/848,154, filed Sep. 29, 2006, entitled "Earth-Boring Rotary Drill Bits Including Wear-Resistant Material Disposed in Recesses Formed in Exterior Surfaces Thereof."

Warrier, S.G., et al., "Infiltration of Titanium Alloy-Matrix Composites," Journal of Materials Science Letters, 12 (1993), pp. 865-868, Chapman & Hall.
PCT International Search Report for International Application PCT/US2007/019085, mailed Jan. 31, 2008.
PCT International Search Report for counterpart PCT International Application No. PCT/US2007/023275, mailed Apr. 11, 2008.
US 4,966,627, 10/1990, Keshavan et al. (withdrawn)

* cited by examiner

PARTICLE-MATRIX COMPOSITE DRILL BITS WITH HARDFACING

PRIORITY CLAIM

This application claims the benefit of U.S. Application Ser. No. 60/848,154, titled "EARTH-BORING ROTARY DRILL BITS INCLUDING WEAR-RESISTANT HARDFACING MATERIAL DISPOSED IN RECESSES FORMED IN EXTERIOR SURFACES THEREOF," which was filed Sep. 29, 2006, and is a continuation-in-part of U.S. application Ser. No. 11/513,677, now U.S. Pat. No. 7,703,555, issued Apr. 27, 2010, titled "COMPOSITE MATERIALS INCLUDING NICKEL-BASED MATRIX MATERIALS AND HARD PARTICLES, TOOLS INCLUDING SUCH MATERIALS, AND METHODS OF USING SUCH MATERIALS," which was filed Aug. 30, 2006; U.S. application Ser. No. 11/272,439, now U.S. Pat. No. 7,776,256, issued Aug. 17, 2010, titled "EARTH BORING ROTARY DRILL BITS AND METHODS OF MANUFACTURING EARTH BORING ROTARY DRILL BITS HAVING PARTICLE MATRIX COMPOSITE BIT BODIES," which was filed Nov. 10, 2005; and U.S. application Ser. No. 11/223,215, now U.S. Pat. No. 7,597,159, issued Oct. 6, 2009, titled "ABRASIVE WEAR-RESISTANT HARDFACING MATERIALS, DRILL BITS AND DRILLING TOOLS INCLUDING ABRASIVE WEAR-RESISTANT HARDFACING MATERIALS, METHODS FOR APPLYING ABRASIVE WEAR-RESISTANT HARDFACING MATERIALS TO DRILL BITS AND DRILLING TOOLS, AND METHODS FOR SECURING CUTTING ELEMENTS TO A DRILL BIT," which was filed Sep. 9, 2005, the disclosure of each of which application is incorporated herein in its entirety by this reference.

FIELD OF THE INVENTION

The invention generally relates to particle-matrix composite drill bits and other tools that may be used in drilling subterranean formations, and to abrasive, wear-resistant hardfacing materials that may be used on surfaces of such particle-matrix composite drill bits and tools. The invention also relates to methods for applying abrasive, wear-resistant hardfacing to surfaces of particle-matrix composite drill bits and tools.

BACKGROUND OF RELATED ART

A conventional fixed-cutter, or "drag," rotary drill bit for drilling subterranean formations includes a bit body having a face region thereon carrying cutting elements for cutting into an earth formation. The bit body may be secured to a hardened steel shank having a threaded pin connection, such as an API threaded pin, for attaching the drill bit to a drill string that includes tubular pipe segments coupled end-to-end between the drill bit and other drilling equipment. Equipment such as a rotary table or top drive may be used for rotating the tubular pipe and drill bit. Alternatively, the shank may be coupled to the drive shaft of a down hole motor to rotate the drill bit independently of, or in conjunction with, a rotary table or top drive.

Typically, the bit body of a drill bit is formed from steel or a combination of a steel blank embedded in a particle-matrix composite material that includes hard particulate material, such as tungsten carbide, infiltrated with a molten binder material such as a copper alloy. The hardened steel shank generally is secured to the bit body after the bit body has been formed. Structural features may be provided at selected locations on and in the bit body to facilitate the drilling process. Such structural features may include, for example, radially and longitudinally extending blades, cutting element pockets, ridges, lands, nozzle ports, and drilling fluid courses and passages. The cutting elements generally are secured to cutting element pockets that are machined into blades located on the face region of the bit body, e.g., the leading edges of the radially and longitudinally extending blades. These structural features, such as the cutting element pockets, may also be formed by a mold used to form the bit body when the molten binder material is infiltrated into the hard particulate material. Advantageously, a particle-matrix composite material provides a bit body of higher strength and toughness compared to steel material, but still requires complex and labor-intensive processes for fabrication, as described in U.S. application Ser. No. 11/272,439. Therefore, it would be desirable to provide a method of manufacturing suitable for producing a bit body that includes a particle-matrix composite material that does not require infiltration of hard particulate material with a molten binder material.

Generally, the cutting elements of a conventional fixed-cutter rotary drill bit each include a cutting surface comprising a hard, superabrasive material, such as mutually bound particles of polycrystalline diamond. Such "polycrystalline diamond compact" (PDC) cutters have been employed on fixed-cutter rotary drill bits in the oil and gas well drilling industries for several decades.

FIG. 1 illustrates a conventional fixed-cutter rotary drill bit 10 generally according to the description above. The rotary drill bit 10 includes a bit body 12 that is coupled to a steel shank 14. A bore (not shown) is formed longitudinally through a portion of the drill bit 10 for communicating drilling fluid to a face 20 of the drill bit 10 via nozzles 19 during drilling operations. Cutting elements 22 (typically polycrystalline diamond compact (PDC) cutting elements) generally are bonded to the face 20 of the bit body 12 by methods such as brazing, adhesive bonding, or mechanical affixation.

A drill bit 10 may be used numerous times to perform successive drilling operations during which the surfaces of the bit body 12 and cutting elements 22 may be subjected to extreme forces and stresses as the cutting elements 22 of the drill bit 10 shear away the underlying earth formation. These extreme forces and stresses cause the cutting elements 22 and the surfaces of the bit body 12 to wear. Eventually, the surfaces of the bit body 12 may wear to an extent at which the drill bit 10 is no longer suitable for use. Therefore, there is a need in the art for enhancing the wear-resistance of the surfaces of the bit body 12. Also, the cutting elements 22 may wear to an extent at which they are no longer suitable for use.

FIG. 2 is an enlarged view of a PDC cutting element 22 like those shown in FIG. 1 secured to the bit body 12. Typically, the cutting elements 22 are fabricated separately from the bit body 12 and secured within pockets 21 formed in the outer, or exterior, surface of the bit body 12 with a bonding material 24 such as an adhesive or, more typically, a braze alloy as previously discussed herein. Furthermore, if the cutting element 22 is a PDC cutter, the cutting element 22 may include a polycrystalline diamond compact table 28 secured to a cutting element body or substrate 23, which may be unitary or comprise two components bonded together.

Conventional bonding material 24 is much less resistant to wear than are other portions and surfaces of the drill bit 10 and of cutting elements 22. During use, small vugs, voids and other defects may be formed in exposed surfaces of the bonding material 24 due to wear. Solids-laden drilling fluids and formation debris generated during the drilling process may further erode, abrade and enlarge the small vugs and voids in the bonding material 24. The entire cutting element 22 may separate from the drill bit body 12 during a drilling operation if enough bonding material 24 is removed. Loss of a cutting element 22 during a drilling operation can lead to rapid wear of other cutting elements and catastrophic failure of the entire drill bit 10. Therefore, there is also a need in the art for an effective method for enhancing the wear-resistance of the bonding material to help prevent the loss of cutting elements during drilling operations.

Ideally, the materials of a rotary drill bit must be extremely hard to withstand abrasion and erosion attendant to drilling earth formations without excessive wear. Due to the extreme forces and stresses to which drill bits are subjected during drilling operations, the materials of an ideal drill bit must simultaneously exhibit high fracture toughness. In practicality, however, materials that exhibit extremely high hardness tend to be relatively brittle and do not exhibit high fracture toughness, while materials exhibiting high fracture toughness tend to be relatively soft and do not exhibit high hardness. As a result, a compromise must be made between hardness and fracture toughness when selecting materials for use in drill bits.

In an effort to simultaneously improve both the hardness and fracture toughness of rotary drill bits, composite materials have been applied to the surfaces of drill bits that are subjected to extreme wear. These composite or hard particle materials are often referred to as "hardfacing" materials and typically include at least one phase that exhibits relatively high hardness and another phase that exhibits relatively high fracture toughness.

FIG. 3 is a representation of a photomicrograph of a polished and etched surface of a conventional hardfacing material applied upon the particulate-matrix composite material, as mentioned above, of a bit body. The hardfacing material includes tungsten carbide particles 40 substantially randomly dispersed throughout an iron-based matrix of matrix material 46. The tungsten carbide particles 40 exhibit relatively high hardness, while the matrix material 46 exhibits relatively high fracture toughness.

Tungsten carbide particles 40 used in hardfacing materials may comprise one or more of cast tungsten carbide particles, sintered tungsten carbide particles, and macrocrystalline tungsten carbide particles. The tungsten carbide system includes two stoichiometric compounds, WC and W2C, with a continuous range of mixtures therebetween. Cast tungsten carbide particles generally include a eutectic mixture of the WC and W2C compounds. Sintered tungsten carbide particles include relatively smaller particles of WC bonded together by a matrix material. Cobalt and cobalt alloys are often used as matrix materials in sintered tungsten carbide particles. Sintered tungsten carbide particles can be formed by mixing together a first powder that includes the relatively smaller tungsten carbide particles and a second powder that includes cobalt particles. The powder mixture is formed in a "green" state. The green powder mixture then is sintered at a temperature near the melting temperature of the cobalt particles to form a matrix of cobalt material surrounding the tungsten carbide particles to form particles of sintered tungsten carbide. Finally, macrocrystalline tungsten carbide particles generally consist of single crystals of WC.

Various techniques known in the art may be used to apply a hardfacing material such as that represented in FIG. 3 to a surface of a drill bit. A welding rod may be configured as a hollow, cylindrical tube formed from the matrix material of the hardfacing material that is filled with tungsten carbide particles. At least one end of the hollow, cylindrical tube may be sealed. The sealed end of the tube then may be melted or welded onto the desired surface on the drill bit. As the tube melts, the tungsten carbide particles within the hollow, cylindrical tube mix with and are suspended in the molten matrix material as it is deposited onto the drill bit. An alternative technique involves forming a cast rod of the hardfacing material and using either an arc or a torch to apply or weld hardfacing material disposed at an end of the rod to the desired surface on the drill bit. One method of applying the hardfacing material by torch is to use what is known as oxy-fuel gas welding. Oxy-fuel gas welding is a group of welding processes which produces coalescence by heating materials with an oxy-fuel gas flame or flames with or without the application of pressure to apply the hardfacing material. One so called "oxy-fuel gas welding" is known as oxygen-acetylene welding (OAW), which is acceptable for applying a hardfacing material to a surface of a drill bit.

Arc welding techniques also may be used to apply a hardfacing material to a surface of a drill bit. For example, a plasma transferred arc may be established between an electrode and a region on a surface of a drill bit on which it is desired to apply a hardfacing material. A powder mixture including both particles of tungsten carbide and particles of matrix material then may be directed through or proximate the plasma-transferred arc onto the region of the surface of the drill bit. The heat generated by the arc melts at least the particles of matrix material to form a weld pool on the surface of the drill bit, which subsequently solidifies to form the hardfacing material layer on the surface of the drill bit.

When a hardfacing material is applied to a surface of a drill bit, relatively high temperatures are used to melt at least the matrix material. At these relatively high temperatures, dissolution may occur between the tungsten carbide particles and the matrix material. In other words, after applying the hardfacing material, at least some atoms originally contained in a tungsten carbide particle (tungsten and carbon, for example) may be found in the matrix material surrounding the tungsten carbide particle. In addition, at least some atoms originally contained in the matrix material (iron, for example) may be found in the tungsten carbide particles. FIG. 4 is an enlarged view of a tungsten carbide particle 40 shown in FIG. 3. At least some atoms originally contained in the tungsten carbide particle 40 (tungsten and carbon, for example) may be found in a region 47 of a matrix material 46 immediately surrounding the tungsten carbide particle 40. The region 47 roughly includes the region of the matrix material 46 enclosed within the phantom line 48. In addition, at least some atoms originally contained in the matrix material 46 (iron, for example) may be found in a peripheral or outer region 41 of the tungsten carbide particle 40. The outer region 41 roughly includes the region of the tungsten carbide particle 40 outside a phantom line 42.

Dissolution between the tungsten carbide particle 40 and the matrix material 46 may embrittle the matrix material 46 in the region 47 surrounding the tungsten carbide particle 40 and reduce the hardness of the tungsten carbide particle 40 in the outer region 41 thereof, reducing the overall effectiveness of the hardfacing material. Dissolution is a process of dissolving a solid, such as the tungsten carbide particle 40, into a liquid, such as the matrix material 46, particularly when at elevated temperatures and when the matrix material 46 is in its liquid phase which transforms the material composition of the matrix material. In one aspect, dissolution is the process where a solid substance enters (generally at elevated temperatures) a molten matrix material, which changes the composition of the matrix material. Dissolution occurs more rapidly as the temperature of the matrix material 46 approaches the melting temperature of tungsten carbide particle 40. For example, an iron-based matrix material will have greater dissolution of the tungsten carbide particles 40 than a nickel-based matrix material will, because of the higher temperatures required in order to bring the iron-based matrix material into a molten state during application. Therefore, there is a need in the art for abrasive, wear-resistant hardfacing materials that include a matrix material that allows for dissolution between tungsten carbide particles and the matrix material to be minimized. There is also a need in the art for methods of applying such abrasive wear-resistant hardfacing materials to surfaces of particle-matrix composite drill bits, and for drill bits and drilling tools that include such particle-matrix composite materials.

BRIEF SUMMARY OF THE INVENTION

A rotary drill bit is provided that provides a particle-matrix composite material devoid of a molten binder or infiltrant material as is conventionally employed in so-called "matrix"-type drill bits. Such a drill bit may also be characterized as having a "sintered" particle-matrix composite structure. Further, the rotary drill bit includes an abrasive, wear-resistant material, which may be characterized as a "hardfacing" material, for enhancing the wear-resistance of surfaces of the drill bit.

In embodiments of the invention, a rotary drill bit includes a bit body substantially formed of a particle-matrix composite material and having an exterior surface and an abrasive wear-resistant material disposed on the exterior surface of the bit body being substantially formed of a particle-matrix composite material.

Methods for applying an abrasive wear-resistant material to a surface of a drill bit in accordance with embodiments of the invention are also provided.

Other advantages, features and alternative aspects of the invention will become apparent when viewed in light of the detailed description of the various embodiments of the invention when taken in conjunction with the attached drawings and appended claims.

BRIEF DESCRIPTION OF THE DRAWINGS

While the specification concludes with claims particularly pointing out and distinctly claiming that which is regarded as the invention, the advantages of this invention may be more readily ascertained from the following description of the invention when read in conjunction with the accompanying drawings in which:

DETAILED DESCRIPTION OF THE INVENTION

Figure 1:
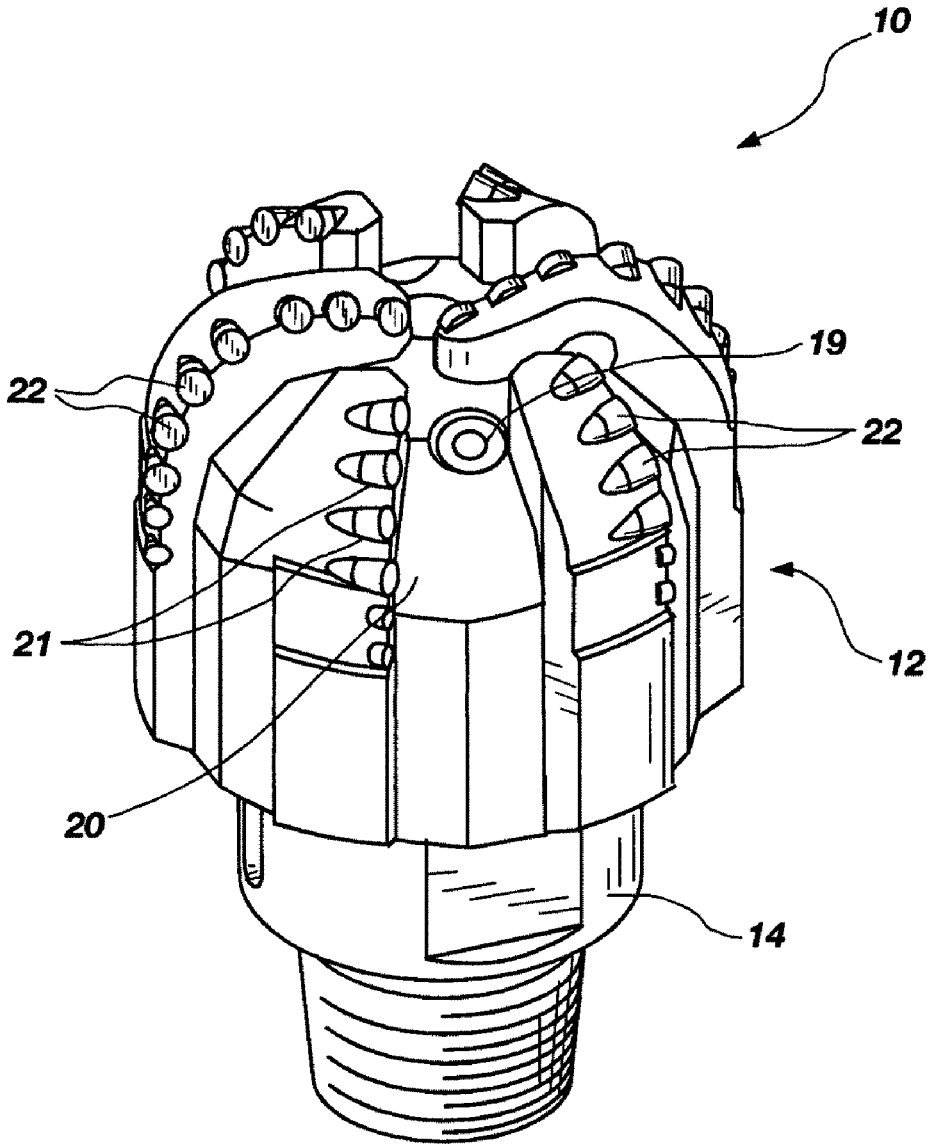
FIG. 1 (PRIOR ART)
FIG. 1 is a perspective view of a conventional rotary drill bit that includes cutting elements.
Figure 2:
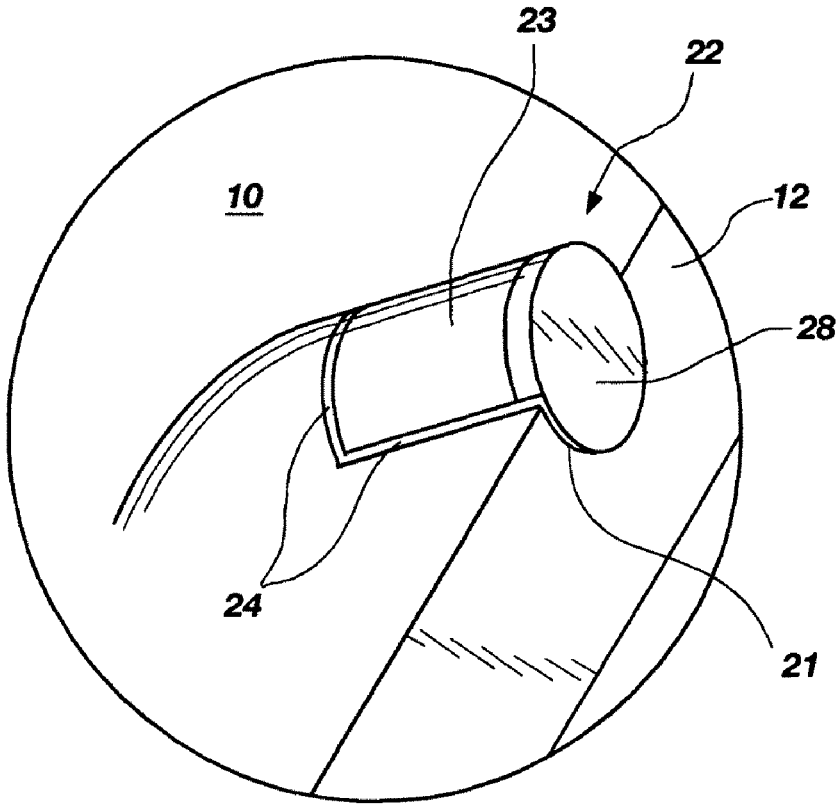
FIG. 2 (PRIOR ART)
FIG. 2 is an enlarged view of a cutting element of the conventional drill bit shown in FIG. 1.
Figure 3:
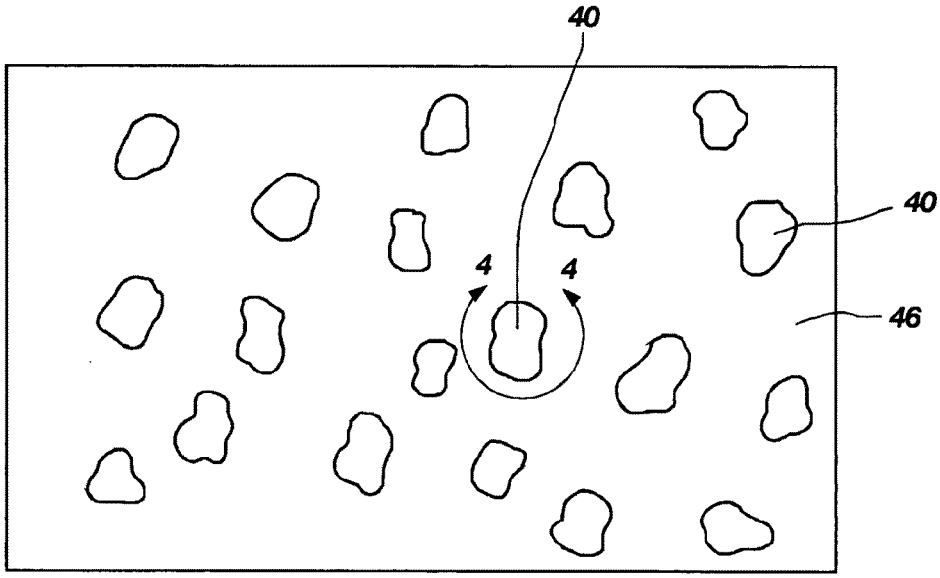
FIG. 3 (PRIOR ART)
FIG. 3 is a representation of a photomicrograph of a conventional abrasive wear-resistant material that includes tungsten carbide particles substantially randomly dispersed throughout a matrix material.
Figure 4:
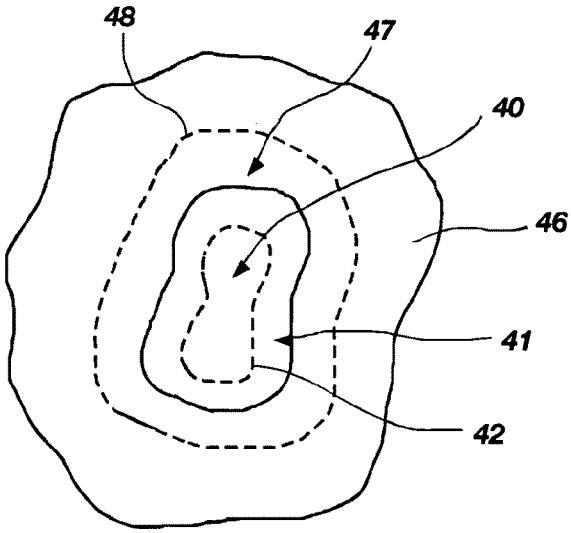
FIG. 4 (PRIOR ART)
FIG. 4 is an enlarged view of a conventional tungsten carbide particle shown in FIG. 3.

The illustrations presented herein are, in some instances, not actual views of any particular drill bit, cutting element, hardfacing material or other feature of a drill bit, but are merely idealized representations which are employed to describe the present invention. Additionally, like elements and features among the various drawing figures are identified for convenience with the same or similar reference numerals.

Figure 5:
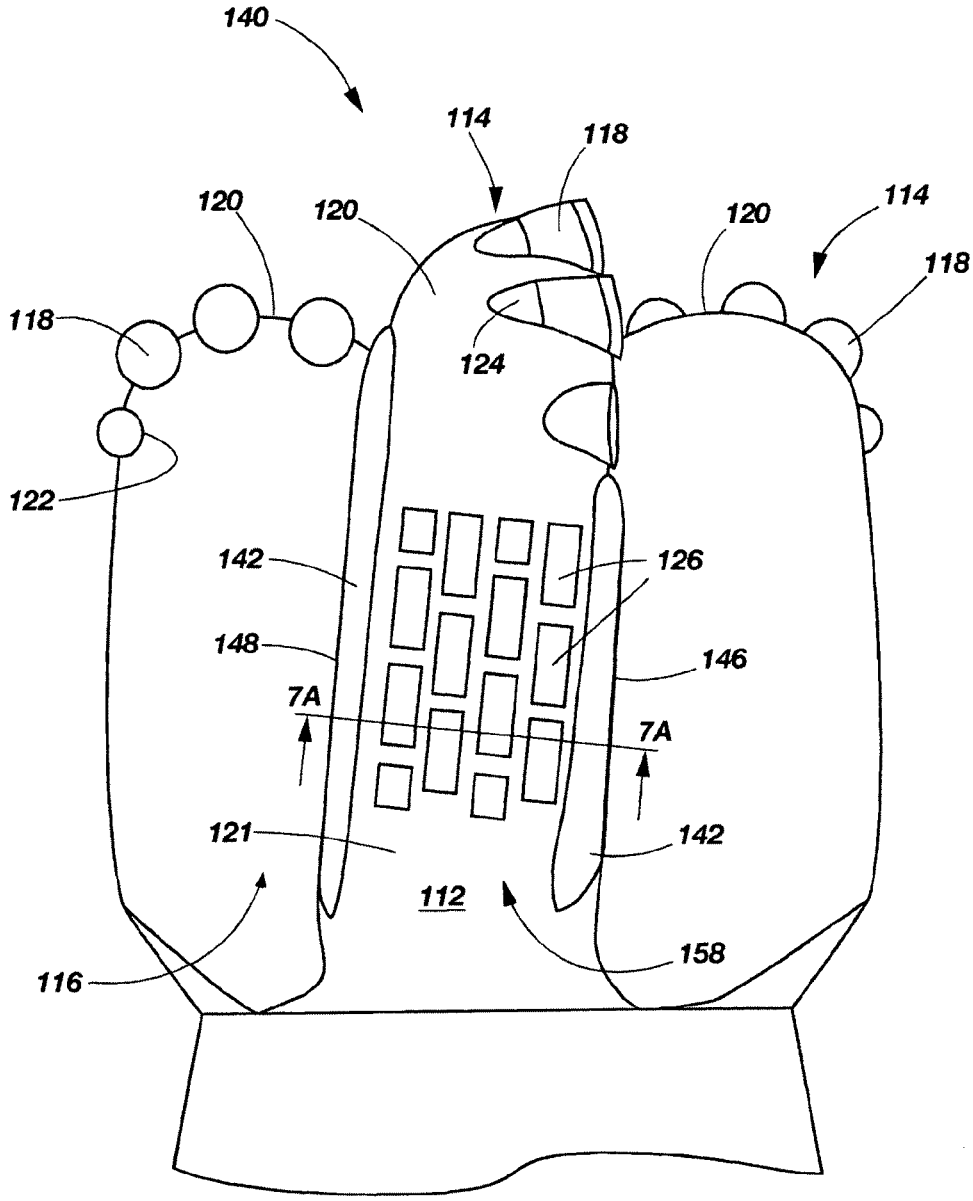
FIG. 5 is a side view of a fixed-cutter rotary drill bit illustrating generally longitudinally extending recesses formed in a blade of the drill bit for receiving abrasive wear-resistant hardfacing material thereon.
Figure 6:
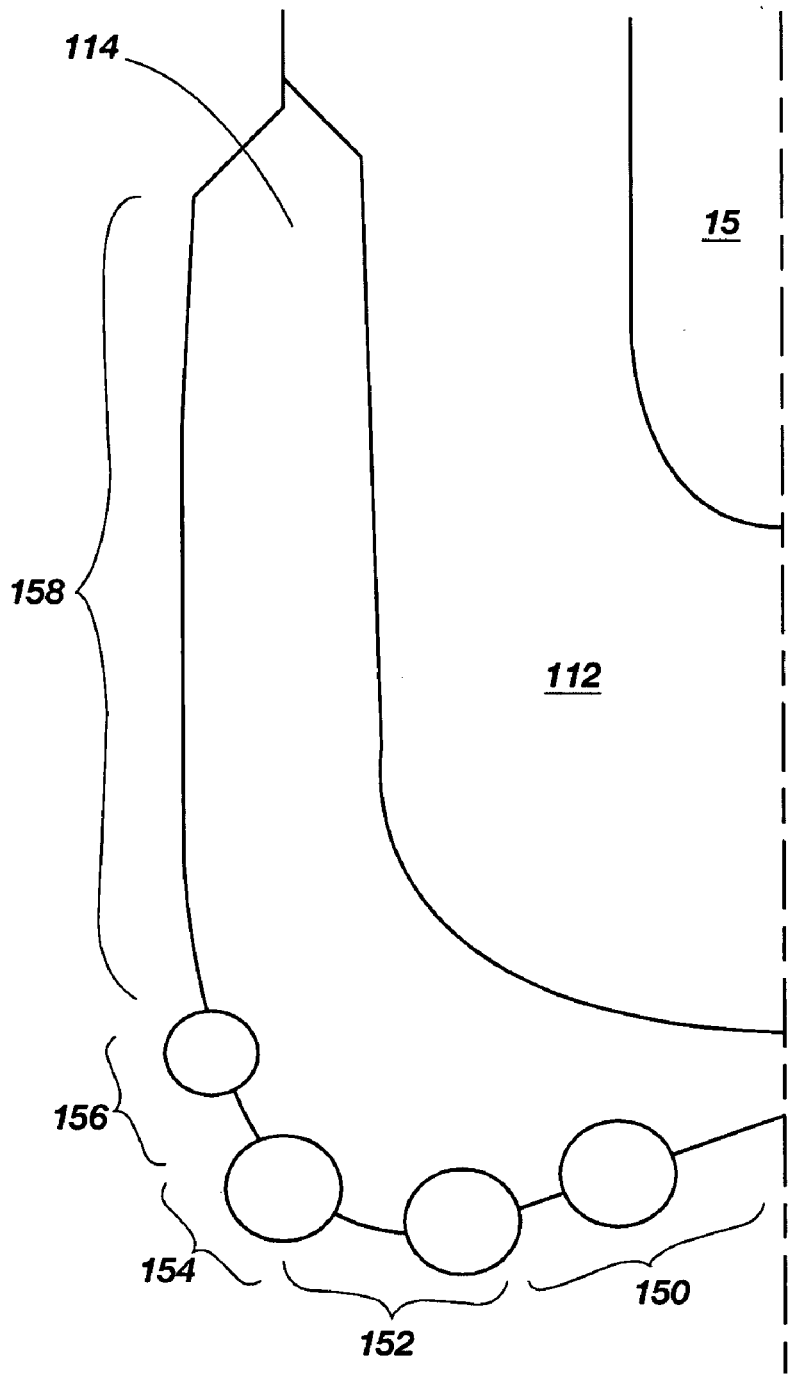
FIG. 6 is a partial side view of one blade of the fixed-cutter rotary drill bit shown in FIG. 5 illustrating the various portions thereof.

Embodiments of the invention may be used to enhance the wear resistance of rotary drill bits, particularly rotary drill bits having a particle-matrix composite material composition with an abrasive wear-resistant hardfacing material applied to surface portions thereof. A rotary drill bit 140 in accordance with an embodiment of the invention is shown in FIG. 5. The drill bit 140 includes a bit body 112 that has generally radially projecting and longitudinally extending wings or blades 114, which are separated by junk slots 116. As shown in FIG. 6, each of the blades 114 may include a cone region 150, a nose region 152, a flank region 154, a shoulder region 156, and a gage region 158 (the flank region 154 and the shoulder region 156 may be collectively referred to in the art as either the "flank" or the "shoulder" of the blade). In some embodiments, the blades 114 may not include a cone region 150. Each of these regions includes an outermost surface that is configured to engage the subterranean formation surrounding a well bore hole during drilling. The cone region 150, nose region 152 and flank region 154 are configured and positioned to engage the formation surfaces at the bottom of the well bore hole and to support the majority of the so-called "weight-on-bit" (WOB) applied through the drill string. These regions carry a majority of the cutting elements 118 attached within pockets 122 upon faces 120 of the blades 114 for cutting or scraping away the underlying formation at the bottom of the well bore. The shoulder region 156 is and configured and positioned to bridge the transition between the bottom of the well bore hole and the wall thereof and the gage region 158 is configured and positioned to engage the formation surfaces on the lateral sides of the well bore hole.

As the formation-engaging surfaces of the various regions of the blades 114 slide and scrape against the formation during application of WOB and rotation to drill a formation, the material of the blades 114 at the formation-engaging surfaces thereof has a tendency to wear away. This wearing away of the material of the blades 114 at the formation-engaging surfaces may lead to loss of cutting elements and/or bit instability (e.g., bit whirl), which may further lead to catastrophic failure of the drill bit 140.

In an effort to reduce the wearing away of the material of the blades 114 at the formation-engaging surfaces, various wear-resistant structures and materials have been placed on and/or in these surfaces of the blades 114. For example, inserts such as bricks, studs, and wear knots formed from an abrasive wear-resistant material, such as, for example, tungsten carbide, have been inset in formation-engaging surfaces of blades 114.

As shown in FIG. 5, a plurality of wear-resistant inserts 126 (each of which may comprise, for example, a tungsten carbide brick) may be inset within the blade 114 at the formation-engaging surface 121 of the blade 114 in the gage region 158 thereof. In additional embodiments, the blades 114 may include wear-resistant structures on or in formation-engaging surfaces of other regions of the blades 114, including the cone region 150, nose region 152, flank region 154, and shoulder region 156 as described with respect to FIG. 6. For example, abrasive wear-resistant inserts may be provided on or in the formation-engaging surfaces of the cone region 150 and/or nose region 152 of the blades 114 rotationally behind one or more cutting elements 118.

Abrasive wear-resistant hardfacing material (i.e., hardfacing material) also may be applied at selected locations on the formation-engaging surfaces of the blades 114. For example, a torch for applying an oxygen-acetylene weld (OAW) or an arc welder, for example, may be used to at least partially melt the wear-resistant hardfacing material to facilitate application of the wear-resistant hardfacing material to the surfaces of the blades 114. Application of the wear-resistant hardfacing material, i.e., hardfacing material, to the bit body 112 is described below.

With continued reference to FIG. 5, recesses 142 for receiving abrasive wear-resistant hardfacing material therein may be formed in the blades 114. By way of example and not limitation, the recesses 142 may extend generally longitudinally along the blades 114, as shown in FIG. 5. A longitudinally extending recess 142 may be formed or otherwise provided along the edge defined by the intersection between the formation-engaging surface 121 and the rotationally leading surface 146 of the blades 114. In addition, a longitudinally extending recess 142 may be formed or otherwise provided along the edge defined by the intersection between the formation-engaging surface 121 and the rotationally trailing surface 148 of the blades 114. One or more of the recesses 142 may extend along the blade 114 adjacent one or more wear-resistant inserts 126.

Figure 7A:
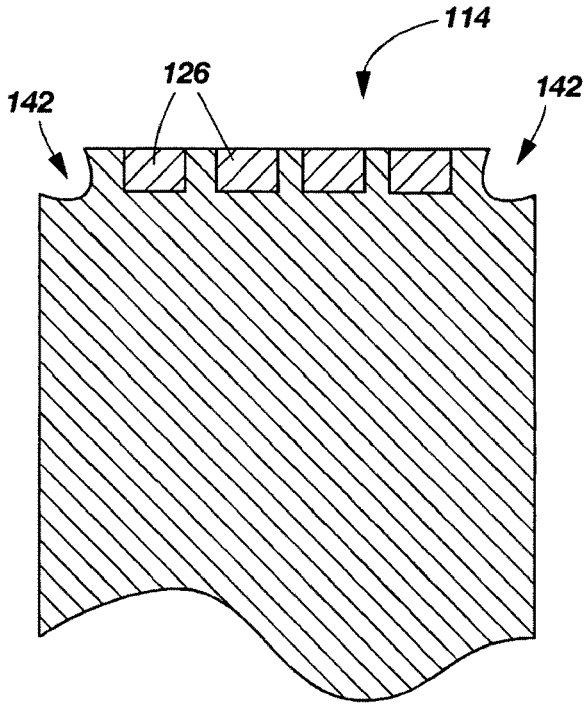
FIG. 7A is a cross-sectional view of a blade of the fixed-cutter rotary drill bit illustrated in FIG. 5, taken generally perpendicular to the longitudinal axis of the drill bit, further illustrating the recesses formed in the blade for receiving abrasive wear-resistant hardfacing material therein.

FIG. 7A is a cross-sectional view of a blade 114 shown in FIG. 5 taken along section line 7A-7A shown therein. As shown in FIG. 7A, the recesses 142 may have a generally semicircular cross-sectional shape. The invention is not so limited, however, and in additional embodiments, the recesses 142 may have a cross-sectional shape that is generally triangular, generally rectangular (e.g., square), or any other shape.

The manner in which the recesses 142 are formed or otherwise provided in the blades 114 may depend on the material from which the blades 114 have been formed. For example, if the blades 114 comprise cemented carbide or other particle-matrix composite material, as described below, the recesses 142 may be formed in the blades 114 using, for example, a conventional milling machine or other conventional machining tool (including hand-held machining tools). Optionally, the recesses 142 may be provided in the blades 114 during formation of the blades 114. The invention is not limited by the manner in which the recesses 142 are formed in the blades 114 of the bit body 112 of the drill bit 140, however, and any method that can be used to form the recesses 142 in a particular drill bit 140 may be used to provide drill bits that embody teachings of the invention.

Figure 7B:
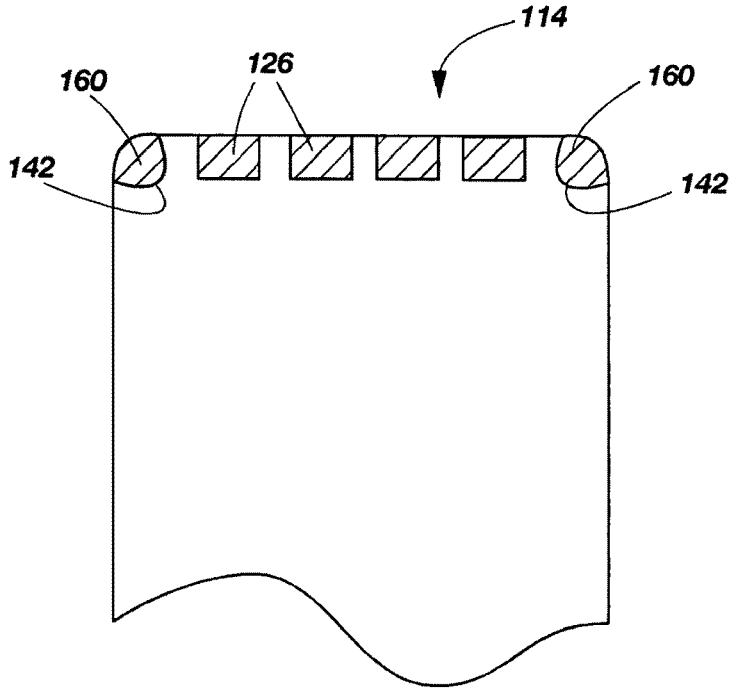
FIG. 7B is a cross-sectional view of the blade of the fixed-cutter rotary drill bit illustrated in FIG. 5 similar to that shown in FIG. 7A, and further illustrating abrasive wear-resistant hardfacing material disposed in the recesses previously provided in the blade.

As shown in FIG. 7B, abrasive wear-resistant hardfacing material 160 may be provided in the recesses 142. In some embodiments, the exposed exterior surfaces of the abrasive wear-resistant hardfacing material 160 provided in the recesses 142 may be substantially coextensive with the adjacent exposed exterior surface of the blade 114. In other words, the abrasive wear-resistant hardfacing material 160 may not project significantly from the surface of the blades 114. In this configuration, the topography of the exterior surface of the blades 114 after filling the recesses 142 with the abrasive wear-resistant hardfacing material 160 may be substantially similar to the topography of the exterior surface of the blades 114 prior to forming the recesses 142. Stated yet another way, the exposed surfaces of the abrasive wear-resistant hardfacing material 160 may be substantially level, or flush, with the surface of the blade 114 adjacent the wear-resistant hardfacing material 160 in a direction generally perpendicular to the region of the blade 114 adjacent the wear-resistant hardfacing material 160. By substantially maintaining the original topography of the exterior surfaces of the blades 114, the forces applied to the exterior surfaces of the blades 114 may be more evenly distributed across the blades 114 in a manner intended by the bit designer. In contrast, when abrasive wear-resistant hardfacing material 160 projects from the exterior surfaces of the blades 114, as the formation engages these projections of abrasive wear-resistant hardfacing material 160, increased localized stresses may develop within the blades 114 in the areas proximate the projections of abrasive wear-resistant hardfacing material 160. The magnitude of these increased localized stresses may be generally proportional to the distance by which the projections extend from the surface of the blades 114 in the direction towards the formation being drilled. Therefore, by configuring the exposed exterior surfaces of the abrasive wear-resistant hardfacing material 160 to substantially match the exposed exterior surfaces of the blades 114 removed when forming the recesses 142, these increased localized stresses may be reduced or eliminated, which may lead to decreased wear and increased service life of the drill bit 140.

It is recognized in other embodiments of the invention, hardfacing material may optionally be applied directly to the face 120 of the bit body 112 without creating recesses 142 while still enhancing the wear-resistance of the surfaces of the bit body.

Figure 8:
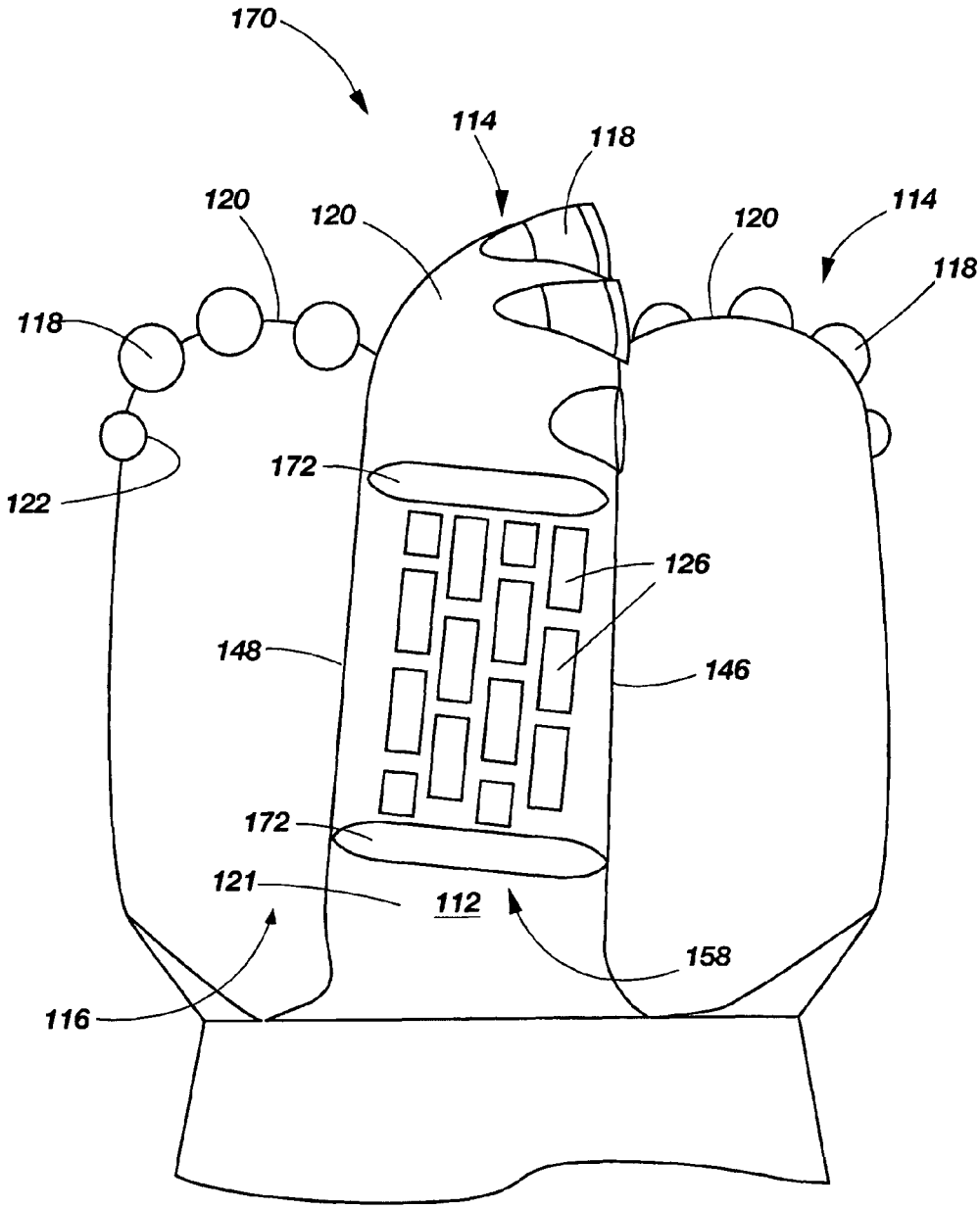
FIG. 8 is a side view of another fixed-cutter rotary drill bit, similar to that shown in FIG. 5, illustrating generally circumferentially extending recesses formed in a blade of the drill bit for receiving abrasive wear-resistant hardfacing material therein.

FIG. 8 illustrates another rotary drill bit 170 according to an embodiment of the invention. The drill bit 170 is generally similar to the drill bit 140 previously described with reference to FIG. 5, and includes a plurality of blades 114 separated by junk slots 116. A plurality of wear-resistant inserts 126 are inset within the formation-engaging surface 121 of each blade 114 in the gage region 158 of the bit body 112. The drill bit 170 further includes a plurality of recesses 172 formed adjacent the region of each blade 114 comprising the plurality of wear-resistant inserts 126. The recesses 172 may be generally similar to the recesses 142 previously described herein in relation to FIGS. 5, 6, 7A, and 7B. The recesses 172 within the face 120 of the bit, however, extend generally circumferentially around the drill bit 170 in a direction generally parallel to the direction of rotation of the drill bit 170 during drilling.

Figure 9:
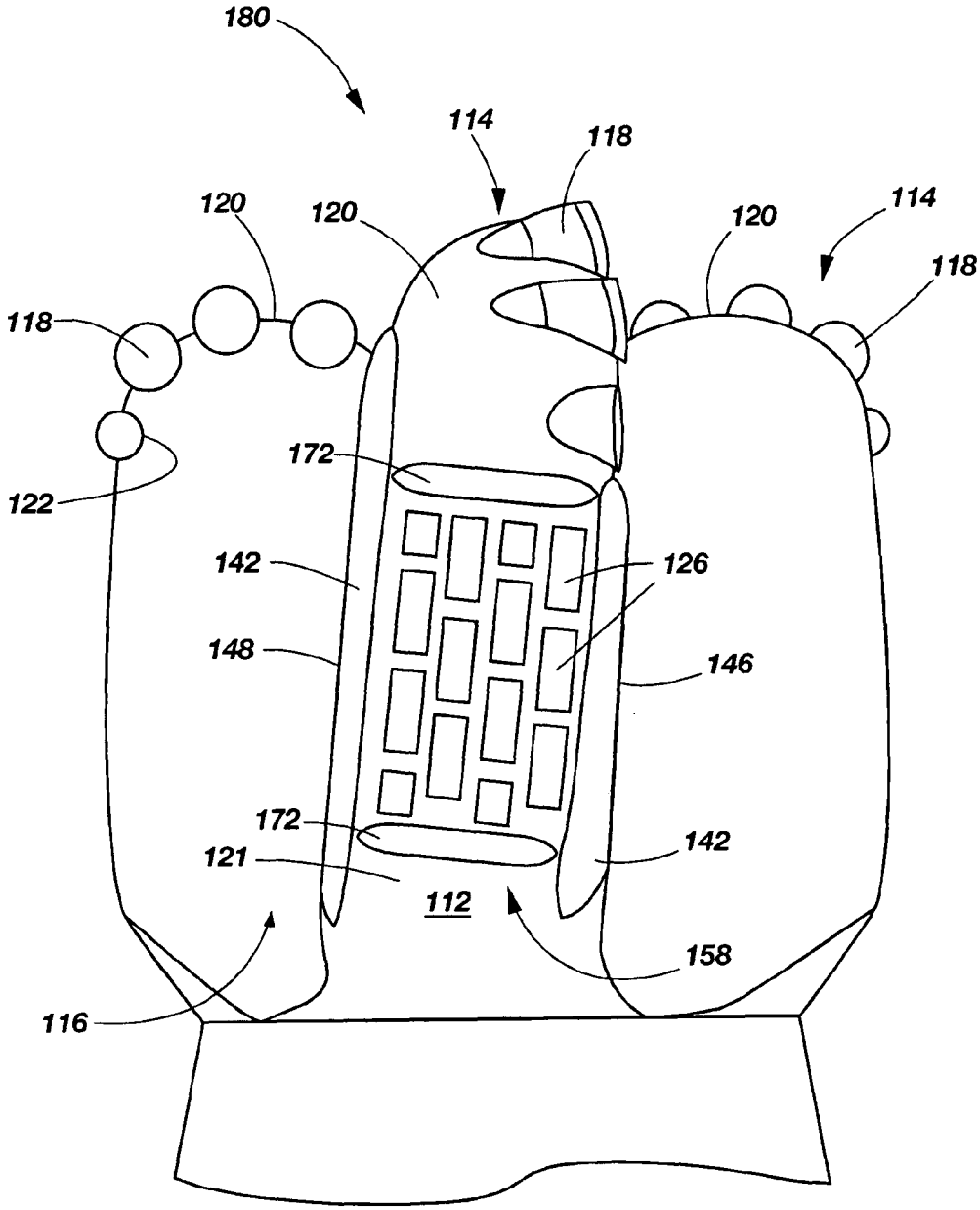
FIG. 9 is a side view of yet another fixed-cutter rotary drill bit, similar to those shown in FIGS. 5 and 8, illustrating both generally longitudinally extending recesses and generally circumferentially extending recesses formed in a blade of the drill bit for receiving abrasive wear-resistant hardfacing material therein.

FIG. 9 illustrates yet another drill bit 180 that embodies teachings of the invention. The fixed-cutter rotary drill bit 180 is generally similar to the drill bit 140 and the drill bit 170, and includes a plurality of blades 114, junk slots 116, and wear-resistant inserts 126 inset within the formation-engaging surface 121 of each blade 114 in the gage region 158 thereof. The drill bit 180, however, includes both generally longitudinally extending recesses 142 like those of the drill bit 140 and generally circumferentially extending recesses 172 like those of the drill bit 170. In this configuration, each plurality of wear-resistant inserts 126 may be substantially peripherally surrounded by recesses 142, 172 that are filled with abrasive wear-resistant hardfacing material 160 (FIG. 7B) generally up to the exposed exterior surface of the blades 114. By substantially surrounding the periphery of each region of the blade 114 comprising a plurality of wear-resistant inserts 126, wearing away of the material of the blade 114 adjacent the plurality of wear-resistant inserts 126 may be reduced or eliminated, which may prevent loss of one or more of the wear-resistant inserts 126 during drilling.

In the embodiment shown in FIG. 9, the regions of the blades 114 comprising a plurality of wear-resistant inserts 126 are substantially peripherally surrounded by recesses 142, 172 that may be filled with abrasive wear-resistant hardfacing material 160 (FIG. 7B). In additional embodiments, one or more wear-resistant inserts of a drill bit may be individually substantially peripherally surrounded by recesses filled with abrasive wear-resistant hardfacing material.

Figure 10:
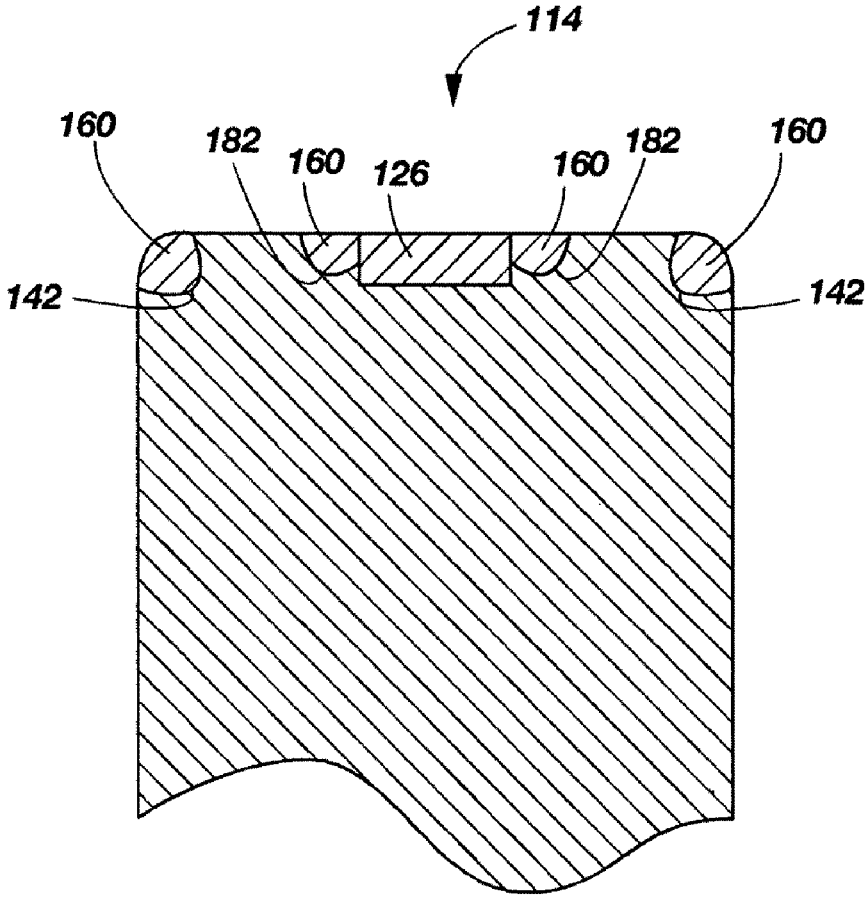
FIG. 10 is a cross-sectional view, similar to those shown in FIGS. 7A and 7B, illustrating recesses formed generally around a periphery of a wear-resistant insert provided in a formation-engaging surface of a blade of a rotary drill bit for receiving abrasive wear-resistant hardfacing material therein.

FIG. 10 is a cross-sectional view of a blade 114 of another drill bit that embodies teachings of the invention. The cross-sectional view is similar to the cross-sectional views shown in FIGS. 7A and 7B. The blade 114 shown in FIG. 10, however, includes a wear-resistant insert 126 that is individually substantially peripherally surrounded by recesses 182 that are filled with abrasive wear-resistant hardfacing material 160. The recesses 182 may be substantially similar to the previously described recesses 142, 172 (FIGS. 5, 8 and 9) and may be filled with abrasive wear-resistant hardfacing material 160. In this configuration, the exposed exterior surfaces of the insert 126, abrasive wear-resistant hardfacing material 160, and regions of the blade 114 adjacent the abrasive wear-resistant hardfacing material 160 may be generally coextensive and planar to reduce or eliminate localized stress concentration caused by any abrasive wear-resistant hardfacing material 160 projecting from the blade 114 generally towards a formation being drilled.

Figure 11:
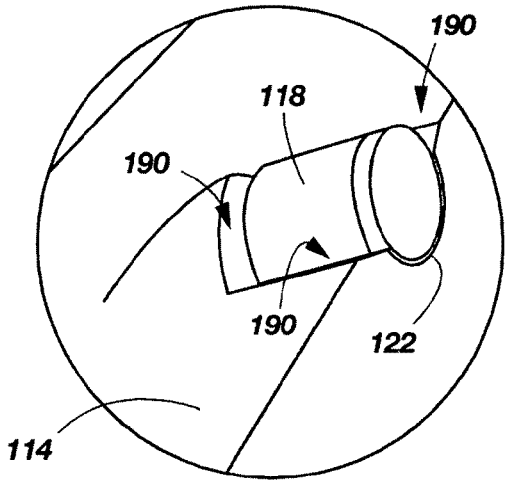
FIG. 11 is a perspective view of a cutting element secured to a blade of a rotary drill bit, and illustrating recesses formed generally around a periphery of the cutting element for receiving abrasive wear-resistant hardfacing material therein.
Figure 12:
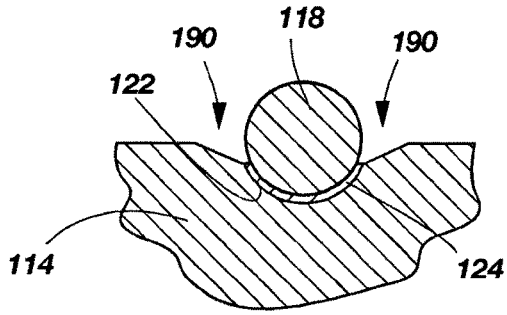
FIG. 12 is a cross-sectional view of a portion of the cutting element and blade shown in FIG. 11, taken generally perpendicular to the longitudinal axis of the cutting element, further illustrating the recesses formed generally around the periphery of the cutting element.
Figure 13:
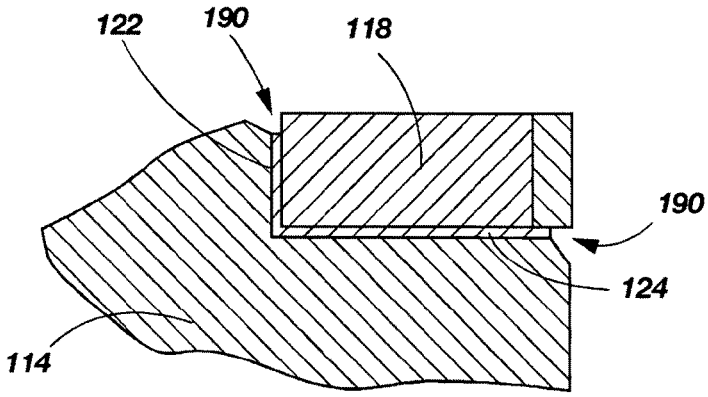
FIG. 13 is another cross-sectional view of a portion of the cutting element and blade shown in FIG. 11, taken generally parallel to the longitudinal axis of the cutting element, further illustrating the recesses formed generally around the periphery of the cutting element.

In additional embodiments, recesses may be provided around cutting elements. FIG. 11 is a perspective view of one cutting element 118 secured within a pocket 122 on a blade 114 of a drill bit similar to each of the previously described drill bits. As shown in each of FIGS. 11-13, recesses 190 may be formed in the blade 114 that substantially peripherally surround the cutting element 118. As shown in FIGS. 12 and 13, the recesses 190 may have a cross-sectional shape that is generally triangular, although, in additional embodiments, the recesses 190 may have any other shape. The cutting element 118 may be secured within the pocket 122 using a bonding material 124 such as, for example, an adhesive or brazing alloy may be provided at the interface and used to secure and attach the cutting element 118 to the blade 114.

Figure 14:
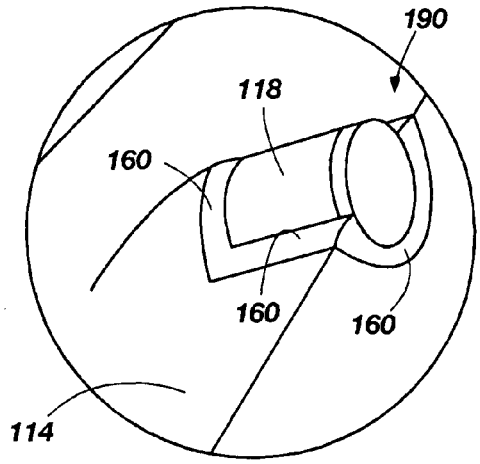
FIG. 14 is a perspective view of the cutting element and blade shown in FIG. 11, further illustrating abrasive wear-resistant hardfacing material disposed in the recesses provided around the periphery of the cutting element.
Figure 15:
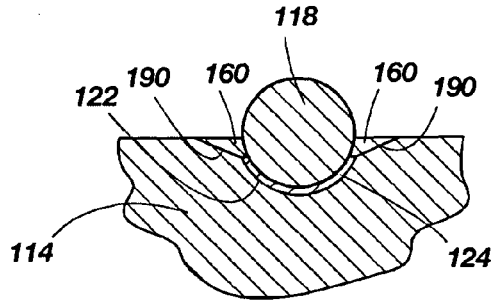
FIG. 15 is a cross-sectional view of the cutting element and blade like that shown in FIG. 12, further illustrating the abrasive wear-resistant hardfacing material provided in the recesses around the periphery of the cutting element.
Figure 16:
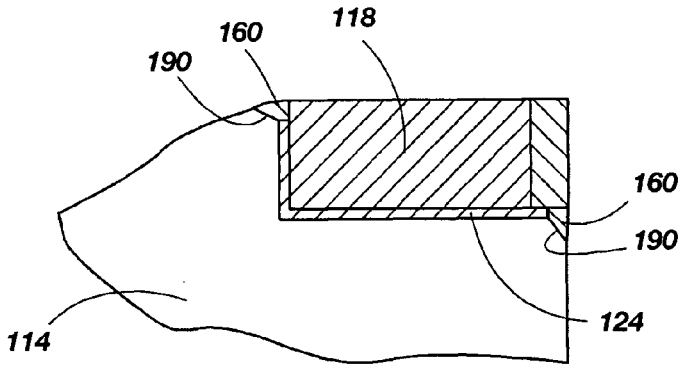
FIG. 16 is a cross-sectional view of the cutting element and blade like that shown in FIG. 13, further illustrating the abrasive wear-resistant hardfacing material provided in the recesses formed around the periphery of the cutting element.

FIGS. 14-16 are substantially similar to FIGS. 11-13, respectively, but further illustrate abrasive wear-resistant hardfacing material 160 disposed within the recesses 190 provided around the cutting element 118. The exposed exterior surfaces of the abrasive wear-resistant hardfacing material 160 and the regions of the blade 114 adjacent the abrasive wear-resistant hardfacing material 160 may be generally coextensive. Furthermore, abrasive wear-resistant hardfacing material 160 may be configured so as not to extend beyond the adjacent surfaces of the blade 114 to reduce or eliminate localized stress concentration caused by any abrasive wear-resistant hardfacing material 160 projecting from the blade 114 generally towards a formation being drilled.

Additionally, in this configuration, the abrasive wear-resistant hardfacing material 160 may cover and protect at least a portion of the bonding material 124 used to secure the cutting element 118 within the pocket 122, which may protect the bonding material 124 from wear during drilling. By protecting the bonding material 124 from wear during drilling, the abrasive wear-resistant hardfacing material 160 may help to prevent separation of the cutting element 118 from the blade 114, damage to the bit body, and catastrophic failure of the drill bit.

Figure 17:
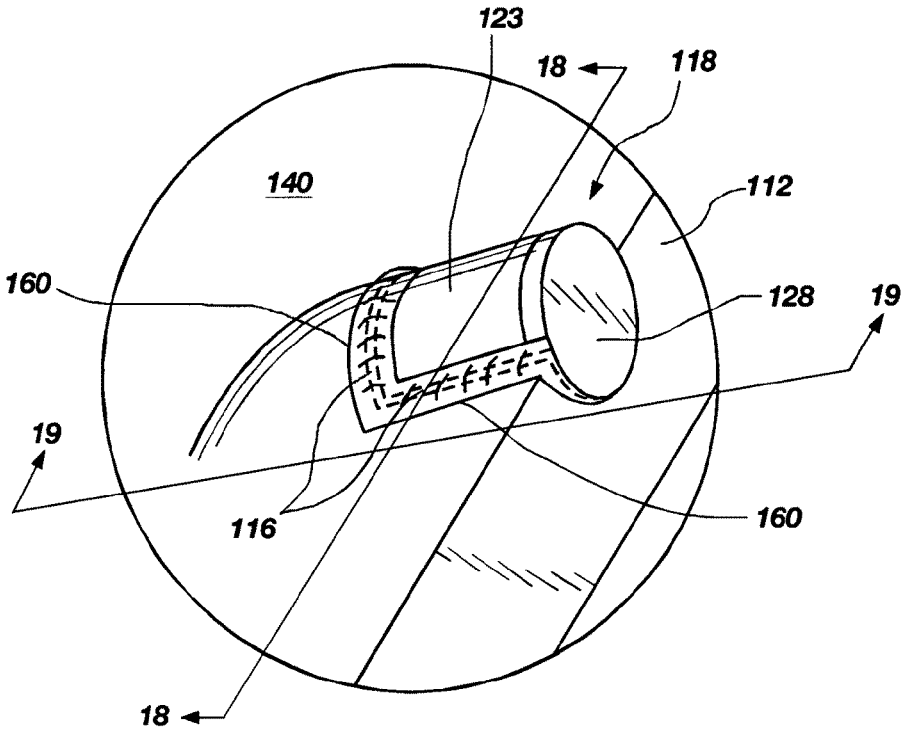
FIG. 17 is a perspective view of a cutting element and blade like that shown in FIG. 11 and further embodies teachings of the invention.
Figure 18:
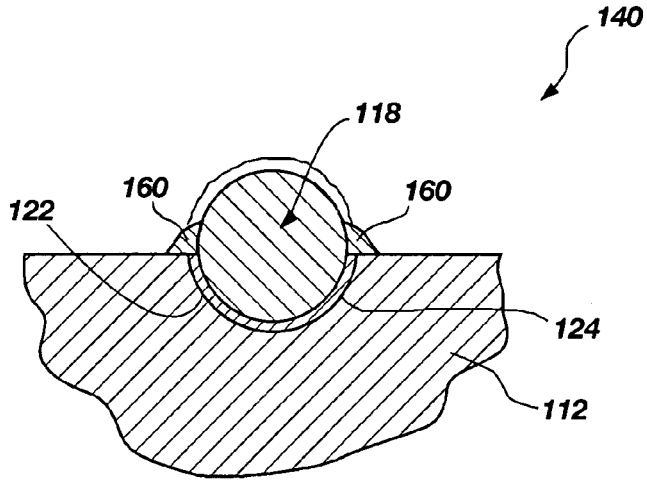
FIG. 18 is a lateral cross-sectional view of the cutting element shown in FIG. 17 taken along section line 18-18 therein.
Figure 19:
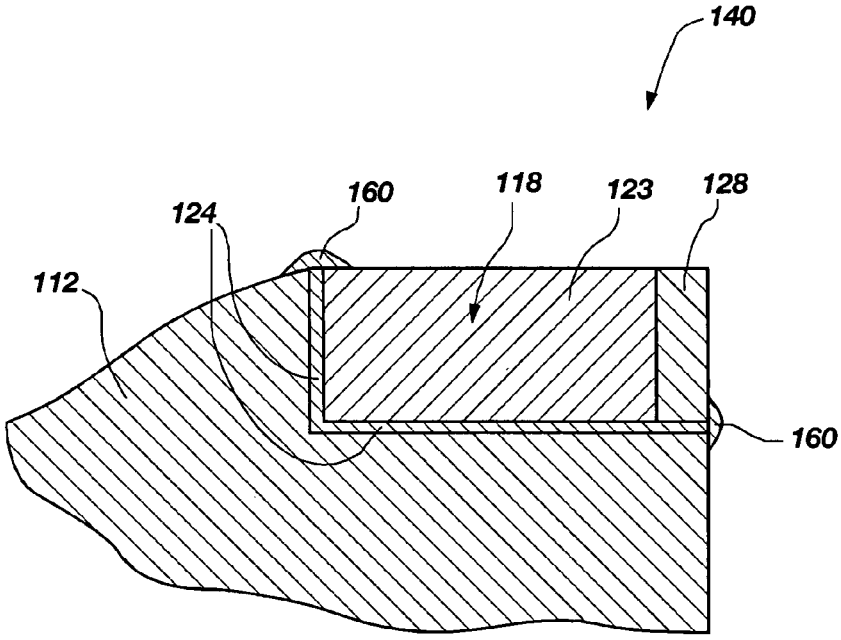
FIG. 19 is a longitudinal cross-sectional view of the cutting element shown in FIG. 17 taken along section line 19-19 therein.

FIGS. 17-19 are substantially similar to FIGS. 11-13, respectively, but further illustrate abrasive wear-resistant hardfacing material 160 disposed upon the bonding material 124 securing the cutting element 118 to the rotary drill bit 140. The rotary drill bit 140 is structurally similar to the rotary drill bit 10 shown in FIG. 1, and includes a plurality of cutting elements 118 positioned and secured within pockets provided on the outer surface of a bit body 112. As illustrated in FIG. 17, each cutting element 118 may be secured to the bit body 112 of the drill bit 140 along an interface therebetween. A bonding material 124 such as, for example, an adhesive or brazing alloy may be provided at the interface and used to secure and attach each cutting element 118 to the bit body 112. The bonding material 124 may be less resistant to wear than the materials of the bit body 112 and the cutting elements 118. Each cutting element 118 may include a polycrystalline diamond compact table 128 attached and secured to a cutting element body or substrate 123 along an interface.

The rotary drill bit 140 further includes an abrasive wear-resistant material 160 disposed on a surface of the drill bit 140. Moreover, regions of the abrasive wear-resistant material 160 may be configured to protect exposed surfaces of the bonding material 124.

FIG. 18 is a lateral cross sectional view of the cutting element 118 shown in FIG. 17 taken along section line 18-18 therein. As illustrated in FIG. 18, continuous portions of the abrasive wear-resistant material 160 may be bonded both to a region of the outer surface of the bit body 112 and a lateral surface of the cutting element 118 and each continuous portion may extend over at least a portion of the interface between the bit body 112 and the lateral sides of the cutting element 118.

FIG. 19 is a longitudinal cross sectional view of the cutting element 118 shown in FIG. 17 taken along section line 19-19 therein. As illustrated in FIG. 19, another continuous portion of the abrasive wear-resistant material 160 may be bonded both to a region of the outer surface of the bit body 112 and a lateral surface of the cutting element 118 and may extend over at least a portion of the interface between the bit body 112 and the longitudinal end surface of the cutting element 118 opposite the a polycrystalline diamond compact table 128. Yet another continuous portion of the abrasive wear-resistant material 160 may be bonded both to a region of the outer surface of the bit body 112 and a portion of the exposed surface of the polycrystalline diamond compact table 128. The continuous portion of the abrasive wear-resistant material 160 may extend over at least a portion of the interface between the bit body 112 and the face of the polycrystalline diamond compact table 128.

In this configuration, the continuous portions of the abrasive wear-resistant material 160 may cover and protect at least a portion of the bonding material 124 disposed between the cutting element 118 and the bit body 112 from wear during drilling operations. By protecting the bonding material 124 from wear during drilling operations, the abrasive wear-resistant material 160 helps to prevent separation of the cutting element 118 from the bit body 112 during drilling operations, damage to the bit body 112, and catastrophic failure of the rotary drill bit 140.

Figure 20:
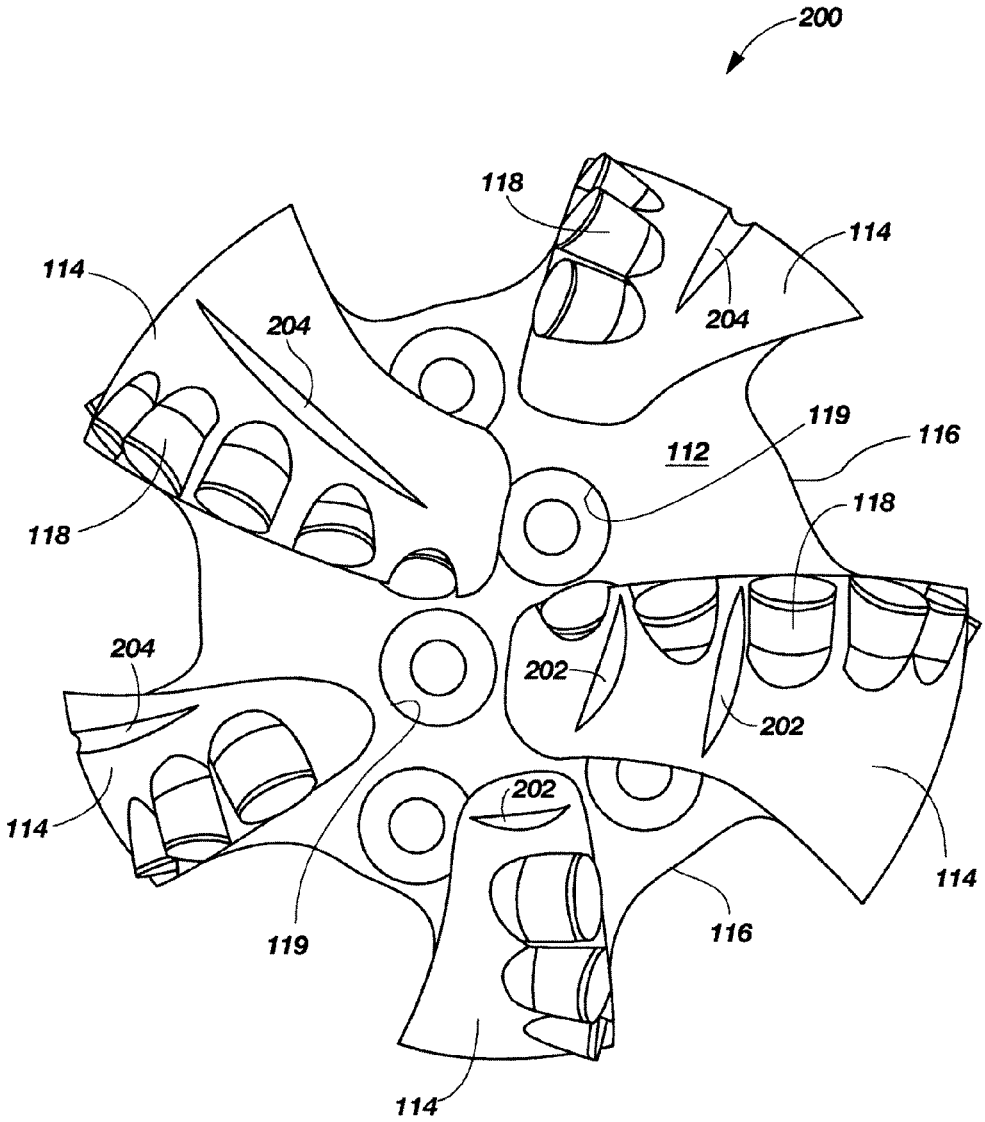
FIG. 20 is an end view of yet another fixed-cutter rotary drill bit illustrating generally recesses formed in nose and cone regions of blades of the drill bit for receiving abrasive wear-resistant hardfacing material therein.

The continuous portions of the abrasive wear-resistant material 160 that cover and protect exposed surfaces of the bonding material 124 may be configured as a bead or beads of abrasive wear-resistant material 160 provided along and over the edges of the interfacing surfaces of the bit body 112 and the cutting element 118. The abrasive wear-resistant material 160 provides an effective method for enhancing the wear-resistance of the bonding material 124 to help prevent the loss of cutting elements 118 during drilling operations FIG. 20 is an end view of yet another rotary drill bit 200. As shown in FIG. 20, in some embodiments of the invention, recesses 202 may be provided between cutting elements 118. For example, the recesses 202 may extend generally circumferentially about a longitudinal axis of the bit (not shown) between cutting elements 118 positioned in the cone region 150 (FIG. 6) and/or the nose region 152 (FIG. 6). Furthermore, as shown in FIG. 20, in some embodiments of the invention, recesses 204 may be provided rotationally behind cutting elements 118. For example, the recesses 204 may extend generally longitudinally along a blade 114 rotationally behind one or more cutting elements 118 positioned in the cone region 150 (FIG. 6) and/or the nose region 152 (FIG. 6). In additional embodiments, the recesses 204 may not be elongated and may have a generally circular or a generally rectangular shape. Such recesses 204 may be positioned directly rotationally behind one or more cutting elements 118, or rotationally behind adjacent cutting elements 118, but at a radial position (measured from the longitudinal axis of the drill bit 200) between the adjacent cutting elements 118. The abrasive wear-resistant material may be applied in the recesses 202, 204 or may be applied upon other surfaces of the rotary drill bit in order to help reduce wear.

The abrasive wear-resistant hardfacing materials described herein may comprise, for example, a ceramic-metal composite material (i.e., a "cermet" material) comprising a plurality of hard ceramic phase regions or particles dispersed throughout a metal matrix material. The hard ceramic phase regions or particles may comprise carbides, nitrides, oxides, and borides (including boron carbide ($B_4C$)). More specifically, the hard ceramic phase regions or particles may comprise carbides and borides made from elements such as W, Ti, Mo, Nb, V, Hf, Ta, Cr, Zr, Al, and Si. By way of example and not limitation, materials that may be used to form hard ceramic phase regions or particles include tungsten carbide, titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). The metal matrix material of the ceramic-metal composite material may include, for example, cobalt-based, iron-based, nickel-based, iron-and nickel-based, cobalt-and nickel-based, iron-and cobalt-based, aluminum-based, copper-based, magnesium-based, and titanium-based alloys. The matrix material may also be selected from commercially pure elements such as cobalt, aluminum, copper, magnesium, titanium, iron, and nickel.

In embodiments of the invention, the abrasive wear-resistant hardfacing materials may be applied to a bit body or tool body and include materials as described below. As used herein, the term "bit" includes not only conventional drill bits, but also core bits, bicenter bits, eccentric bits and tools employed in drilling of a well bore.

Figure 21:
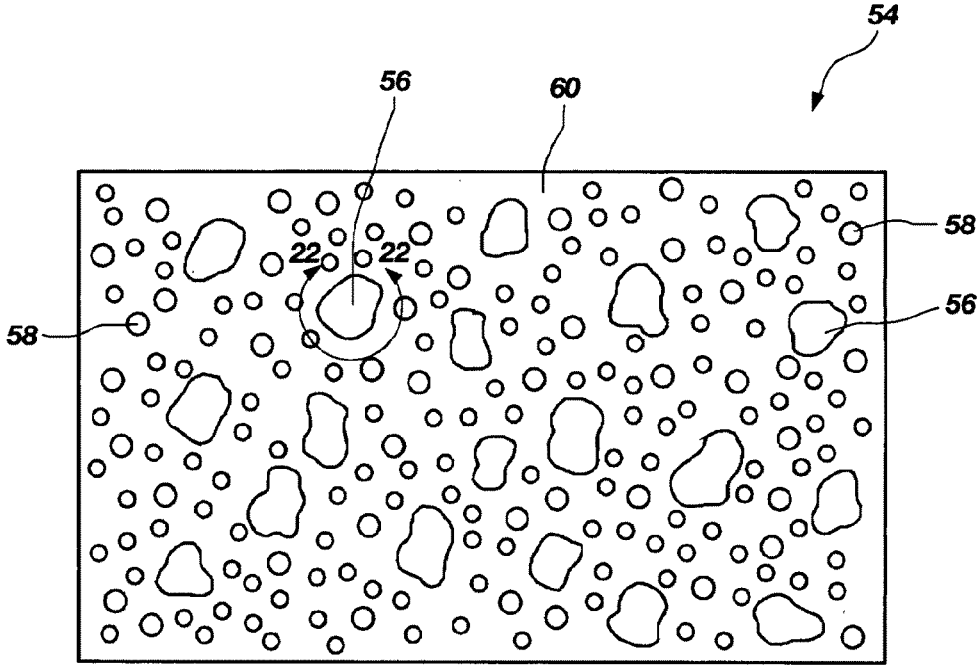
FIG. 21 is a representation of a photomicrograph of an abrasive wear-resistant material that embodies teachings of the invention and that includes tungsten carbide particles substantially randomly dispersed throughout a matrix.
Figure 23A:
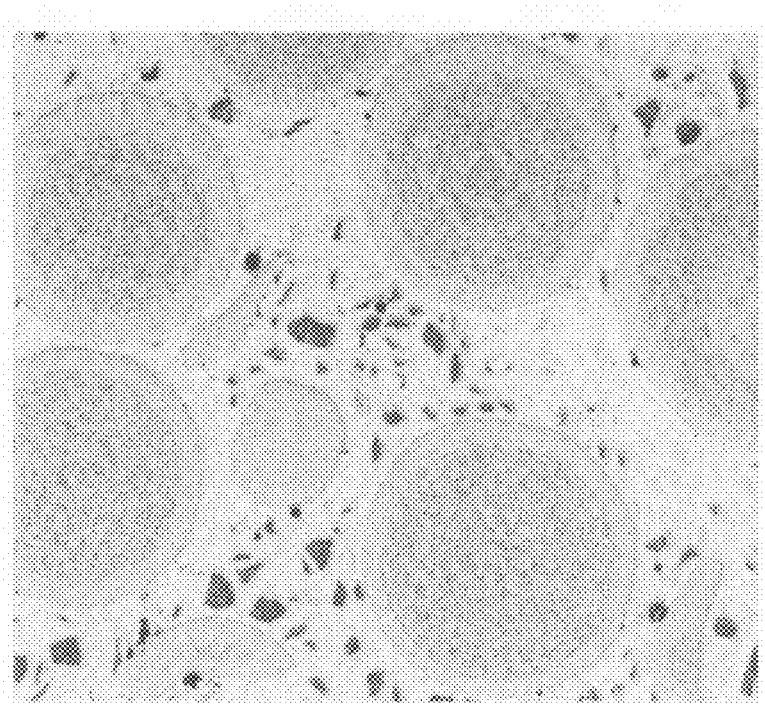
FIGS. 23A and 23B are photomicrographs of an abrasive wear-resistant hardfacing material that embodies teachings of the invention and that includes tungsten carbide particles substantially randomly dispersed throughout a matrix.
Figure 23B:
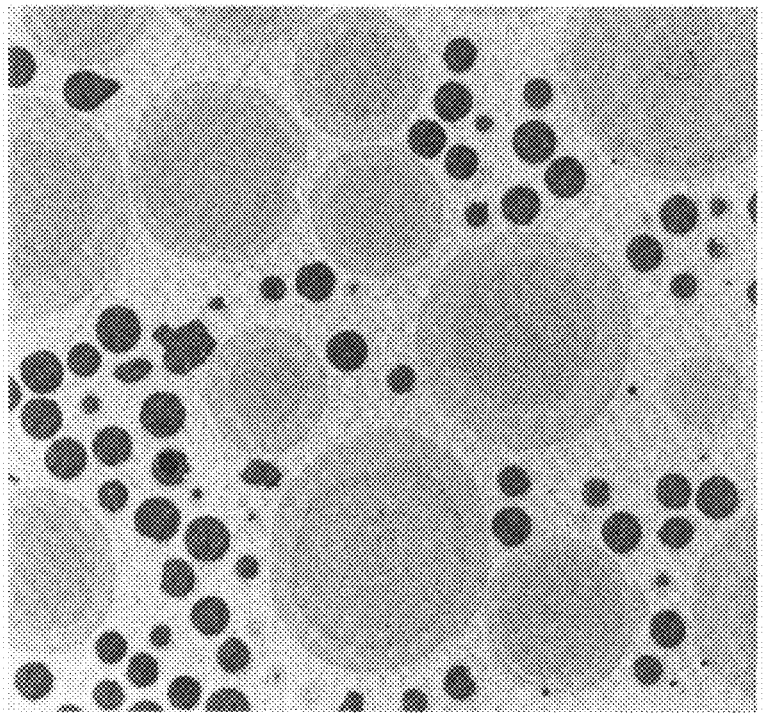

FIG. 21 represents a polished and etched surface of an abrasive wear-resistant material 54 according to an embodiment of the invention, particularly suitable for applying the material as a "hardfacing" upon a drill bit having a particle-matrix composite material. FIGS. 23A and 23B are actual photomicrographs of a polished and etched surface of an abrasive wear-resistant material according to embodiments of the invention. Referring to FIG. 21, the abrasive wear-resistant material 54 includes a plurality of sintered tungsten carbide pellets 56 and a plurality of cast tungsten carbide granules 58 substantially randomly dispersed throughout a matrix material 60. Each sintered tungsten carbide pellet 56 may have a generally spherical pellet configuration. The term "pellet," as used herein, means any particle having a generally spherical shape. Pellets are not true spheres, but lack the corners, sharp edges, and angular projections commonly found in crushed and other non spherical tungsten carbide particles. In some embodiments of the invention, the cast tungsten carbide granules may be or include cast tungsten carbide pellets, as shown in FIG. 23B. In still other embodiments of the invention, the cast tungsten carbide granules may be or include crushed cast tungsten carbide or crushed sintered tungsten carbide, as shown in FIG. 23A.

Corners, sharp edges, and angular projections may produce residual stresses, which may cause tungsten carbide material in the regions of the particles proximate the residual stresses to melt at lower temperatures during application of the abrasive wear-resistant material 54 to a surface of a drill bit. Melting or partial melting of the tungsten carbide material during application may facilitate dissolution between the tungsten carbide particles and the surrounding matrix material. As previously discussed herein, dissolution between the matrix material 60 and the sintered tungsten carbide pellets 56 and cast tungsten carbide granules 58 may embrittle the matrix material 60 in regions surrounding the tungsten carbide pellets 56, and cast tungsten carbide granules 58 and may reduce the toughness of the hardfacing material, particularly when the matrix material 60 is iron based. Such dissolution may degrade the overall physical properties of the abrasive wear-resistant material 54. The use of sintered tungsten carbide pellets 56 (and, optionally, cast tungsten carbide pellets 58) instead of conventional tungsten carbide particles that include corners, sharp edges, and angular projections may reduce such dissolution, preserving the physical properties of the matrix material 60 and the sintered tungsten carbide pellets 56 (and, optionally, the cast tungsten carbide pellets 58) during application of the abrasive wear-resistant material 54 to the surfaces of drill bits and other tools.

The matrix material 60 may comprise between about 20% and about 50% by weight of the abrasive wear-resistant material 54. More particularly, the matrix material 60 may comprise between about 35% and about 45% by weight of the abrasive wear-resistant material 54. The plurality of sintered tungsten carbide pellets 56 may comprise between about 30% and about 55% by weight of the abrasive wear-resistant material 54. Furthermore, the plurality of cast tungsten carbide granules 58 may comprise less than about 35% by weight of the abrasive wear-resistant material 54. More particularly, the plurality of cast tungsten carbide granules 58 may comprise between about 10% and about 35% by weight of the abrasive wear-resistant material 54. For example, the matrix material 60 may be about 40% by weight of the abrasive wear-resistant material 54, the plurality of sintered tungsten carbide pellets 56 may be about 48% by weight of the abrasive wear-resistant material 54, and the plurality of cast tungsten carbide granules 58 may be about 12% by weight of the abrasive wear-resistant material 54.

The sintered tungsten carbide pellets 56 may be larger in size than the cast tungsten carbide granules 58. Furthermore, the number of cast tungsten carbide granules 58 per unit volume of the abrasive wear-resistant material 54 may be higher than the number of sintered tungsten carbide pellets 56 per unit volume of the abrasive wear-resistant material 54.

The sintered tungsten carbide pellets 56 may include −10 ASTM (American Society for Testing and Materials) mesh pellets. As used herein, the phrase "−10 ASTM mesh pellets" means pellets that are capable of passing through an ASTM No. 10 U.S.A. standard testing sieve. Such sintered tungsten carbide pellets may have an average diameter of less than about 1680 microns. The average diameter of the sintered tungsten carbide pellets 56 may be between about 0.8 times and about 20 times greater than the average diameter of the cast tungsten carbide granules 58. The cast tungsten carbide granules 58 may include −16 ASTM mesh granules. As used herein, the phrase "−16 ASTM mesh granules" means granules that are capable of passing through an ASTM No. 16 U.S.A. standard testing sieve. More particularly, the cast tungsten carbide granules 58 may include −100 ASTM mesh granules. As used herein, the phrase "−100 ASTM mesh granules" means granules that are capable of passing through an ASTM No. 100 U.S.A. standard testing sieve. Such cast tungsten carbide granules 58 may have an average diameter of less than about 150 microns.

As an example, the sintered tungsten carbide pellets 56 may include −20/+30 ASTM mesh pellets, and the cast tungsten carbide granules 58 may include −100/+270 ASTM mesh granules. As used herein, the phrase "−20/+30 ASTM mesh pellets" means pellets that are capable of passing through an ASTM No. 20 U.S.A. standard testing sieve, but incapable of passing through an ASTM No. 30 U.S.A. standard testing sieve. Such sintered tungsten carbide pellets 56 may have an average diameter of less than about 840 microns and greater than about 590 microns. Furthermore, the phrase "−100/+270 ASTM mesh granules," as used herein, means granules capable of passing through an ASTM No. 100 U.S.A. standard testing sieve, but incapable of passing through an ASTM No. 270 U.S.A. standard testing sieve. Such cast tungsten carbide granules 58 may have an average diameter in a range from approximately 50 microns to about 150 microns.

As another example, the plurality of sintered tungsten carbide pellets 56 may include a plurality of −60/+80 ASTM mesh sintered tungsten carbide pellets and a plurality of −120/+270 ASTM mesh sintered tungsten carbide pellets. The plurality of −60/+80 ASTM mesh sintered tungsten carbide pellets may comprise between about 30% and about 40% by weight of the abrasive wear-resistant material 54, and the plurality of −120/+270 ASTM mesh sintered tungsten carbide pellets may comprise between about 15% and about 25% by weight of the abrasive wear-resistant material 54. As used herein, the phrase "−120/+270 ASTM mesh pellets" means pellets capable of passing through an ASTM No. 120 U.S.A. standard testing sieve, but incapable of passing through an ASTM No. 270 U.S.A. standard testing sieve. Such sintered tungsten carbide pellets 56 may have an average diameter in a range from approximately 50 microns to about 125 microns.

In one particular embodiment, set forth merely as an example, the abrasive wear-resistant material 54 may include about 40% by weight matrix material 60, about 48% by weight −20/+30 ASTM mesh sintered tungsten carbide pellets 56, and about 12% by weight −140/+325 ASTM mesh cast tungsten carbide granules 58. As used herein, the phrase "−20/+30 ASTM mesh pellets" means pellets that are capable of passing through an ASTM No. 20 U.S.A. standard testing sieve, but incapable of passing through an ASTM No. 30 U.S.A. standard testing sieve. Similarly, the phrase "−140/+325 ASTM mesh pellets" means pellets that are capable of passing through an ASTM No. 140 U.S.A. standard testing sieve, but incapable of passing through an ASTM No. 325 U.S.A. standard testing sieve. The matrix material 60 may include a nickel-based alloy, which may further include one or more additional elements, such as, for example, chromium, boron, and silicon. The matrix material 60 also may have a melting point of less than about 1100° C., and may exhibit a hardness of between about 87 on the Rockwell B Scale and about 60 on the Rockwell C Scale. Hardness values herein are represented of actual or converted hardness microhardness determinations. More particularly, the matrix material 60 may exhibit a hardness of between about <20 and about 55 on the Rockwell C Scale. For example, the matrix material 60 may exhibit a hardness of about 40 on the Rockwell C Scale.

Cast granules and sintered pellets of carbides other than tungsten carbide also may be used to provide abrasive wear-resistant materials that embody teachings of the invention. Such other carbides include, but are not limited to, chromium carbide, molybdenum carbide, niobium carbide, tantalum carbide, titanium carbide, and vanadium carbide.

The matrix material 60 may comprise a metal alloy material having a melting point that is less than about 1460° C. More particularly, the matrix material 60 may comprise a metal alloy material having a melting point that is less than about 1100° C. Furthermore, each sintered tungsten carbide pellet 56 of the plurality of sintered tungsten carbide pellets 56 may comprise a plurality of tungsten carbide particles bonded together with a binder alloy having a melting point that is greater than about 1200° C. For example, the binder alloy may comprise a cobalt-based metal alloy material or a nickel-based alloy material having a melting point that is lower than about 1200° C. In this configuration, the matrix material 60 may be substantially melted during application of the abrasive wear-resistant material 54 to a surface of a drilling tool such as a drill bit without substantially melting the cast tungsten carbide granules 58, or the binder alloy or the tungsten carbide particles of the sintered tungsten carbide pellets 56. This enables the abrasive wear-resistant material 54 to be applied to a surface of a drilling tool at relatively lower temperatures to minimize dissolution between the sintered tungsten carbide pellets 56 and the matrix material 60 and between the cast tungsten carbide granules 58 and the matrix material 60.

As previously discussed herein, minimizing atomic diffusion between the matrix material 60 and the sintered tungsten carbide pellets 56 and cast tungsten carbide granules 58, helps to preserve the chemical composition and the physical properties of the matrix material 60, the sintered tungsten carbide pellets 56, and the cast tungsten carbide granules 58 during application of the abrasive wear-resistant material 54 to the surfaces of drill bits and other tools.

The matrix material 60 also may include relatively small amounts of other elements, such as carbon, chromium, silicon, boron, iron, silver, and nickel. Furthermore, the matrix material 60 also may include a flux material such as silicomanganese, an alloying element such as niobium, and a binder such as a polymer material.

Figure 22:
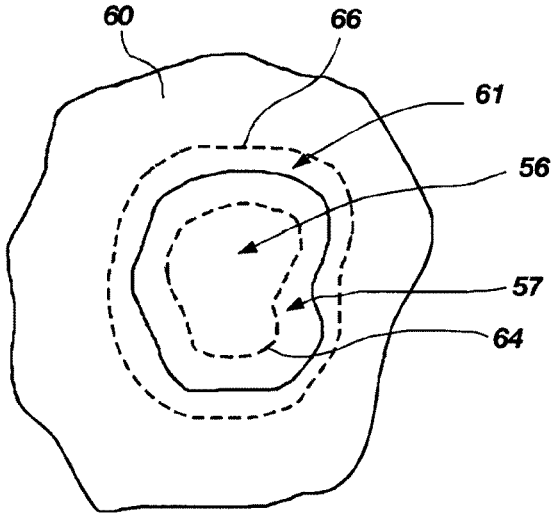
FIG. 22 is an enlarged view of a tungsten carbide particle shown in FIG. 21.

FIG. 22 is an enlarged view of a sintered tungsten carbide pellet 56 shown in FIG. 21. The hardness of the sintered tungsten carbide pellet 56 may be substantially consistent throughout the pellet. For example, the sintered tungsten carbide pellet 56 may include a peripheral or outer region 57 of the sintered tungsten carbide pellet 56. The outer region 57 may roughly include the region of the sintered tungsten carbide pellet 56 outside the phantom line 64. The outer region 61 roughly includes the region of the matrix material 60 enclosed within the phantom line 66. The sintered tungsten carbide pellet 56 may exhibit a first average hardness in the central region of the pellet enclosed by the phantom line 64, and a second average hardness at locations within the peripheral region 57 of the pellet outside the phantom line 64. The second average hardness of the sintered tungsten carbide pellet 56 may be greater than about 99% of the first average hardness of the sintered tungsten carbide pellet 56. As an example, the first average hardness may be about 91 on the Rockwell A Scale, and the second average hardness may be about 90 on the Rockwell A Scale for a nickel base matrix material and may be about 86 on the Rockwell A Scale for an iron-based matrix material. It is to be recognized that prior to applying the hardfacing material 56, the sintered tungsten carbide pellets may exhibit an overall hardness of about 85 on the Rockwell A Scale to about 92 on the Rockwell A Scale when containing between about 16% Co to about 4% Co, respectively. Also, the sintered tungsten carbide pellets may have an average hardness on the range of 89-91 on the Rockwell A Scale when containing about 6% Co. Generally during application of the hardfacing material, nickel-based matrix composites usually allows the sintered tungsten carbide pellets to substantially maintain their original hardness. Whereas, iron-based matrix composites may partially dissolve the sintered tungsten carbide pellets near their edges, which may lower the after application hardness by several Rockwell points below its pre-application hardness.

The sintered tungsten carbide pellets 56 may have relatively high fracture toughness relative to the cast tungsten carbide granules 58, while the cast tungsten carbide granules 58 may have relatively high hardness relative to the sintered tungsten carbide pellets 56. By using matrix materials 60 as described herein, the fracture toughness of the sintered tungsten carbide pellets 56 and the hardness of the cast tungsten carbide granules 58 may be preserved in the abrasive wear-resistant material 54 during application of the abrasive wear-resistant material 54 to a drill bit or other drilling tool, providing an abrasive wear-resistant material 54 that is improved relative to abrasive wear-resistant materials known in the art.

Abrasive wear-resistant materials according to embodiments of the invention, such as the abrasive wear-resistant material 54 illustrated in FIGS. 21 and 22, may be applied to selected areas on surfaces of rotary drill bits (such as the rotary drill bit 10 shown in FIG. 1), rolling cutter drill bits (commonly referred to as "roller cone" drill bits), and other drilling tools that are subjected to wear, such as ream while drilling tools and expandable reamer blades, all such apparatuses and others being encompassed, as previously indicated, within the term "drill bit."

Certain locations on a surface of a drill bit may require relatively higher hardness, while other locations on the surface of the drill bit may require relatively higher fracture toughness. The relative weight percentages of the matrix material 60, the plurality of sintered tungsten carbide pellets 56, and the plurality of cast tungsten carbide granules 58 may be selectively varied to provide an abrasive wear-resistant material 54 that exhibits physical properties tailored to a particular tool or to a particular area on a surface of a tool. For example, the surfaces of cutting teeth on a rolling-cutter-type drill bit may be subjected to relatively high impact forces in addition to frictional-type abrasive or grinding forces. Therefore, abrasive wear-resistant material 54 applied to the surfaces of the cutting teeth may include a higher weight percentage of sintered tungsten carbide pellets 56 in order to increase the fracture toughness of the abrasive wear-resistant material 54. In contrast, gage surfaces of a drill bit may be subjected to relatively little impact force but relatively high frictional-type abrasive or grinding forces. Therefore, abrasive wear-resistant material 54 applied to the gage surfaces of a drill bit may include a higher weight percentage of cast tungsten carbide granules 58 in order to increase the hardness of the abrasive wear-resistant material 54.

In addition to being applied to selected areas on surfaces of drill bits and drilling tools that are subjected to wear, the abrasive wear-resistant materials according to embodiments of the invention may be used to protect structural features or materials of drill bits and drilling tools that are relatively more prone to wear, including the examples presented above.

The abrasive wear-resistant material 54 may be used to cover and protect interfaces between any two structures or features of a drill bit or other drilling tool. For example, the interface between a bit body and a periphery of wear knots or any type of insert in the bit body may be covered and protected by abrasive wear-resistant material 54. In addition, the abrasive wear-resistant material 54 is not limited to use at interfaces between structures or features and may be used at any location on any surface of a drill bit or drilling tool that is subjected to wear.

Abrasive wear-resistant materials according to embodiments of the invention, such as the abrasive wear-resistant material 54, may be applied to the selected surfaces of a drill bit or drilling tool using variations of techniques known in the art. For example, a pre-application abrasive wear-resistant material according to embodiments of the invention may be provided in the form of a welding rod. The welding rod may comprise a solid, cast or extruded rod consisting of the abrasive wear-resistant material 54. Alternatively, the welding rod may comprise a hollow cylindrical tube formed from the matrix material 60 and filled with a plurality of sintered tungsten carbide pellets 56 and a plurality of cast tungsten carbide granules 58. An OAW torch or any other type of gas fuel torch may be used to heat at least a portion of the welding rod to a temperature above the melting point of the matrix material 60. This may minimize the extent of atomic diffusion occurring between the matrix material 60 and the sintered tungsten carbide pellets 56 and cast tungsten carbide granules 58.

The rate of dissolution occurring between the matrix material 60 and the sintered tungsten carbide pellets 56 and cast tungsten carbide granules 58 is at least partially a function of the temperature at which dissolution occurs. The extent of dissolution, therefore, is at least partially a function of both the temperature at which dissolution occurs and the time for which dissolution is allowed to occur. Therefore, the extent of dissolution occurring between the matrix material 60 and the sintered tungsten carbide pellets 56 and the cast tungsten carbide granules 58 may be controlled by employing good heat management control.

The OAW torch may be capable of heating materials to temperatures in excess of 1200° C. It may be beneficial to slightly melt the surface of a drill bit or drilling tool to which the abrasive wear-resistant material 54 is to be applied just prior to applying the abrasive wear-resistant material 54 to the surface. For example, the OAW torch may be brought in close proximity to a surface of a drill bit or drilling tool and used to heat to the surface to a sufficiently high temperature to slightly melt or "sweat" the surface. The welding rod comprising pre-application wear-resistant material 54 may then be brought in close proximity to the surface, and the distance between the torch and the welding rod may be adjusted to heat at least a portion of the welding rod to a temperature above the melting point of the matrix material 60 to melt the matrix material 60. The molten matrix material 60, at least some of the sintered tungsten carbide pellets 56, and at least some of the cast tungsten carbide granules 58 may be applied to the surface of a drill bit, and the molten matrix material 60 may be solidified by controlled cooling. The rate of cooling may be controlled to control the microstructure and physical properties of the abrasive wear-resistant material 54.

Alternatively, the abrasive wear-resistant material 54 may be applied to a surface of a drill bit or drilling tool using an arc welding technique, such as a plasma-transferred arc welding technique. For example, the matrix material 60 may be provided in the form of a powder (small particles of matrix material 60). A plurality of sintered tungsten carbide pellets 56 and a plurality of cast tungsten carbide granules 58 may be mixed with the powdered matrix material 60 to provide a pre-application wear-resistant material in the form of a powder mixture. A plasma-transferred arc welding machine then may be used to heat at least a portion of the pre-application wear-resistant material to a temperature above the melting point of the matrix material 60 and less than about 1200° C. to melt the matrix material 60.

Other welding techniques, such as metal inert gas (MIG) arc welding techniques, tungsten inert gas (TIG) arc welding techniques, and flame spray welding techniques are known in the art and may be used to apply the abrasive wear-resistant material 54 to a surface of a drill bit or drilling tool.

The abrasive wear-resistant material, i.e., hardfacing, is suitable for application upon a bit body made from particle-matrix composite material or so called "cemented carbide" material. The particle-matrix composite material for a bit body is now presented together with some terminology to facilitate a proper understanding of the invention.

The term "green," as used herein, means unsintered.

The term "green bit body," as used herein, means an unsintered structure comprising a plurality of discrete particles held together by a binder material, the structure having a size and shape allowing the formation of a bit body suitable for use in an earth boring drill bit from the structure by subsequent manufacturing processes including, but not limited to, machining and densification.

The term "brown," as used herein, means partially sintered.

The term "brown bit body," as used herein, means a partially sintered structure comprising a plurality of particles, at least some of which have partially grown together to provide at least partial bonding between adjacent particles, the structure having a size and shape allowing the formation of a bit body suitable for use in an earth boring drill bit from the structure by subsequent manufacturing processes including, but not limited to, machining and further densification. Brown bit bodies may be formed by, for example, partially sintering a green bit body.

The term "sintering," as used herein, means densification of a particulate component involving removal of at least a portion of the pores between the starting particles (accompanied by shrinkage) combined with coalescence and bonding between adjacent particles.

As used herein, the term "[metal]-based alloy" (where [metal] is any metal) means commercially pure [metal] in addition to metal alloys wherein the weight percentage of [metal] in the alloy is greater than the weight percentage of any other component of the alloy.

As used herein, the term "material composition" means the chemical composition and microstructure of a material. In other words, materials having the same chemical composition but a different microstructure are considered to have different material compositions.

As used herein, the term "tungsten carbide" means any material composition that contains chemical compounds of tungsten and carbon, such as, for example, WC, W2C, and combinations of WC and W2C. Tungsten carbide includes, for example, cast tungsten carbide, sintered tungsten carbide, and macrocrystalline tungsten carbide.

The rotary drill bit 140, as shown in FIG. 5, includes a bit body 112 substantially formed from and composed of a particle-matrix composite material. The drill bit 140 also may include a shank (not shown) attached to the bit body 112. However, the bit body 112 does not include a steel blank integrally formed therewith, as conventionally required for infiltrated particle-matrix materials as described above, for attaching the bit body 112 to the shank.

The particle-matrix composite material of the bit body 112 may include a plurality of hard particles randomly dispersed throughout a matrix material. The hard particles may comprise diamond or ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide, titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art.

The matrix material 60 of the particle-matrix composite material may include, for example, cobalt-based, iron-based, nickel-based, iron-and nickel-based, cobalt-and nickel-based, iron-and cobalt-based, aluminum-based, copper-based, magnesium-based, and titanium-based alloys. The matrix material may also be selected from commercially pure elements such as cobalt, aluminum, copper, magnesium, titanium, iron, and nickel. By way of example and not limitation, the matrix material may include carbon steel, alloy steel, stainless steel, tool steel, Hadfield manganese steel, nickel or cobalt superalloy material, and low thermal expansion iron-or nickel-based alloys such as INVAR®. As used herein, the term "superalloy" refers to an iron-, nickel-, and cobalt-based alloys having at least 12% chromium by weight. Additional examples of alloys that may be used as matrix material include austenitic steels, nickel-based superalloys such as INCONEL® 625M or Rene 95, and INVAR®-type alloys having a coefficient of thermal expansion that closely matches that of the hard particles used in the particular particle-matrix composite material. More closely matching the coefficient of thermal expansion of matrix material with that of the hard particles offers advantages such as reducing problems associated with residual stresses and thermal fatigue. Another example of a suitable matrix material is a Hadfield austenitic manganese steel (Fe with approximately 12% Mn by weight and 1.1% C by weight).

In embodiments of the invention, the particle-matrix composite material may include a plurality of −400 ASTM (American Society for Testing and Materials) mesh tungsten carbide particles. As used herein, the phrase "−400 ASTM mesh particles" means particles that pass through an ASTM No. 400 mesh screen as defined in ASTM specification E11 04 entitled Standard Specification for Wire Cloth and Sieves for Testing Purposes. Such tungsten carbide particles may have a diameter of less than about 38 microns. A matrix material may include a metal alloy comprising about 50% cobalt by weight and about 50% nickel by weight. The tungsten carbide particles may comprise between about 60% and about 95% by weight of the particle-matrix composite material, and the matrix material may comprise between about 5% and about 40% by weight of the particle-matrix composite material. More particularly, the tungsten carbide particles may comprise between about 70% and about 80% by weight of the particle-matrix composite material, and the matrix material may comprise between about 20% and about 30% by weight of the particle-matrix composite material.

In another embodiment of the invention, the particle-matrix composite material may include a plurality of −635 ASTM mesh tungsten carbide particles. As used herein, the phrase "−635 ASTM mesh particles" means particles that pass through an ASTM No. 635 mesh screen as defined in ASTM specification E11 04 entitled Standard Specification for Wire Cloth and Sieves for Testing Purposes. Such tungsten carbide particles may have a diameter of less than about 20 microns. A matrix material may include a cobalt-based metal alloy comprising substantially commercially pure cobalt. For example, the matrix material may include greater than about 98% cobalt by weight. The tungsten carbide particles may comprise between about 60% and about 95% by weight of the particle-matrix composite material, and the matrix material may comprise between about 5% and about 40% by weight of the particle-matrix composite material.

FIGS. 24A-24E illustrate a method of forming the bit body used in accordance with embodiments of the invention set for above. The bit body, such as the bit body 200 shown in FIG. 20, is substantially formed from and composed of a particle-matrix composite material. The method generally includes providing a powder mixture, pressing the powder mixture to form a green body, and at least partially sintering the powder mixture.

Figure 24A:
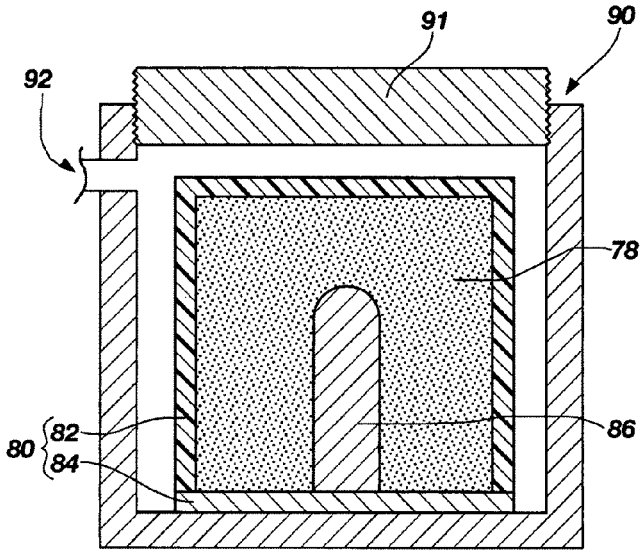
FIGS. 24A-24E illustrate a method of forming the bit body having a particle-matrix composite material therein, similar to the rotary drill bit shown in FIG. 20.

Referring to FIG. 24A, a powder mixture 78 may be pressed with substantially isostatic pressure within a mold or container 80. The powder mixture 78 may include a plurality of the previously described hard particles and a plurality of particles comprising a matrix material, as also previously described herein. Optionally, the powder mixture 78 may further include additives commonly used when pressing powder mixtures such as, for example, binders for providing lubrication during pressing and for providing structural strength to the pressed powder component, plasticizers for making the binder more pliable, and lubricants or compaction aids for reducing interparticle friction.

The container 80 may include a fluid-tight deformable member 82. For example, the fluid tight deformable member 82 may be a substantially cylindrical bag comprising a deformable polymer material. The container 80 may further include a sealing plate 84, which may be substantially rigid. The deformable member 82 may be formed from, for example, an elastomer such as rubber, neoprene, silicone, or polyurethane. The deformable member 82 may be filled with the powder mixture 78 and vibrated to provide a uniform distribution of the powder mixture 78 within the deformable member 82. At least one displacement or insert 86 may be provided within the deformable member 82 for defining features of the bit body, such as, for example, a longitudinal bore 15 (FIG. 6). Alternatively, the insert 86 may not be used and the longitudinal bore 15 may be formed using a conventional machining process during subsequent processes. The sealing plate 84 then may be attached or bonded to the deformable member 82 providing a fluid-tight seal therebetween.

The container 80 (with the powder mixture 78 and any desired inserts 86 contained therein) may be placed within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 at high pressures using a pump (not shown). The high pressure of the fluid causes the walls of the deformable member 82 to deform. The fluid pressure may be transmitted substantially uniformly to the powder mixture 78. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascals (20,000 pounds per square inch). In other methods, a vacuum may be provided within the container 80 and a pressure greater than about 0.1 megapascals (about 15 pounds per square inch) may be applied to the exterior surfaces of the container 80 (by, for example, the atmosphere) to compact the powder mixture 78. Isostatic pressing of the powder mixture 78 may form a green powder component or green bit body 94 shown in FIG. 24B, which can be removed from the pressure chamber 90 and container 80 after pressing.

Figure 24B:
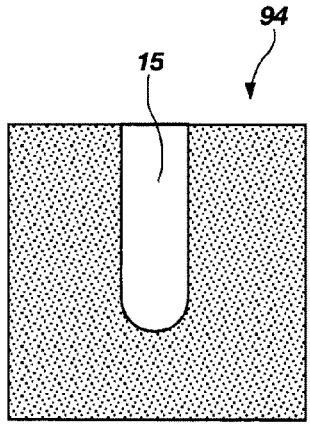

In another method of pressing the powder mixture 78 to form the green bit body 94 shown in FIG. 24B, the powder mixture 78 may be pressed, such as with a uniaxial press, in a mold or die (not shown) using a mechanically or hydraulically actuated plunger by methods that are known to those of ordinary skill in the art of powder processing.

The green bit body 94 shown in FIG. 24B may include a plurality of particles (hard particles and particles of matrix material) held together by a binder material provided in the powder mixture 78 (FIG. 24A), as previously described. Certain structural features may be machined in the green bit body 94 using conventional machining techniques including, for example, turning techniques, milling techniques, and drilling techniques. Hand-held tools also may be used to manually form or shape features in or on the green bit body 94. By way of example and not limitation, blades 114, junk slots 116 (FIG. 20), and surface 96 may be machined or otherwise formed in the green bit body 94 to form a shaped green bit body 98 shown in FIG. 24C.

Figure 24C:
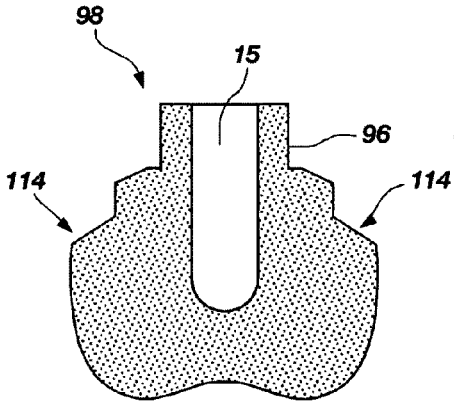
Figure 24D:
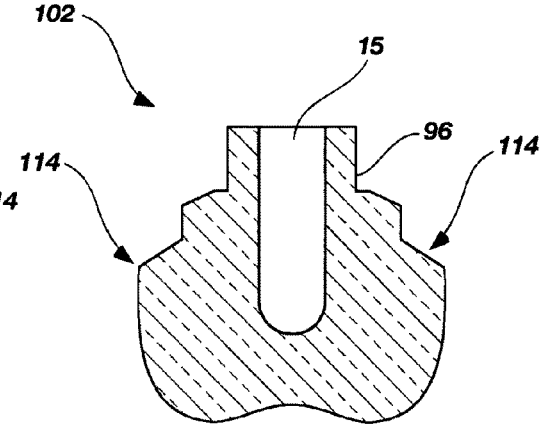

The shaped green bit body 98 shown in FIG. 24C may be at least partially sintered to provide a brown bit body 102 shown in FIG. 24D, which has less than a desired final density. Prior to partially sintering the shaped green bit body 98, the shaped green bit body 98 may be subjected to moderately elevated temperatures and pressures to burn off or remove any fugitive additives that were included in the powder mixture 78 (FIG. 24A), as previously described. Furthermore, the shaped green bit body 98 may be subjected to a suitable atmosphere tailored to aid in the removal of such additives. Such atmospheres may include, for example, hydrogen gas at temperatures of about 500° C.

The brown bit body 102 may be substantially machinable due to the remaining porosity therein. Certain structural features may be machined in the brown bit body 102 using conventional machining techniques including, for example, turning techniques, milling techniques, and drilling techniques. Hand-held tools also may be used to manually form or shape features in or on the brown bit body 102. Tools that include superhard coatings or inserts may be used to facilitate machining of the brown bit body 102. Additionally, material coatings may be applied to surfaces of the brown bit body 102 that are to be machined to reduce chipping of the brown bit body 102. Such coatings may include a fixative or other polymer material.

Figure 24E:
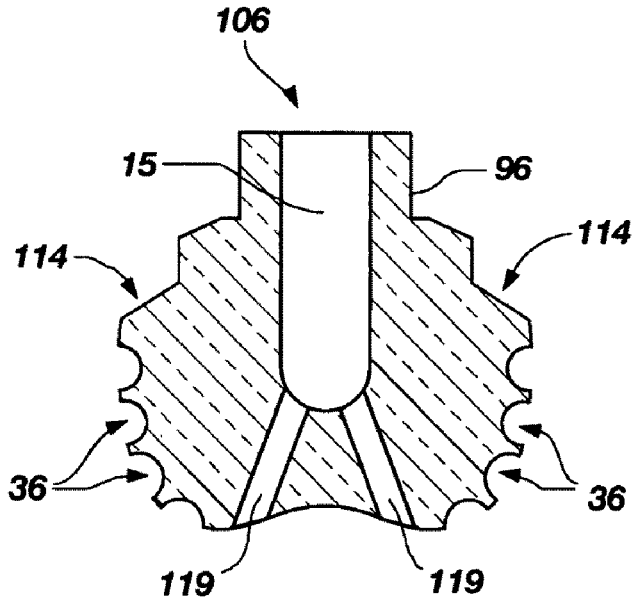
Figure 17:
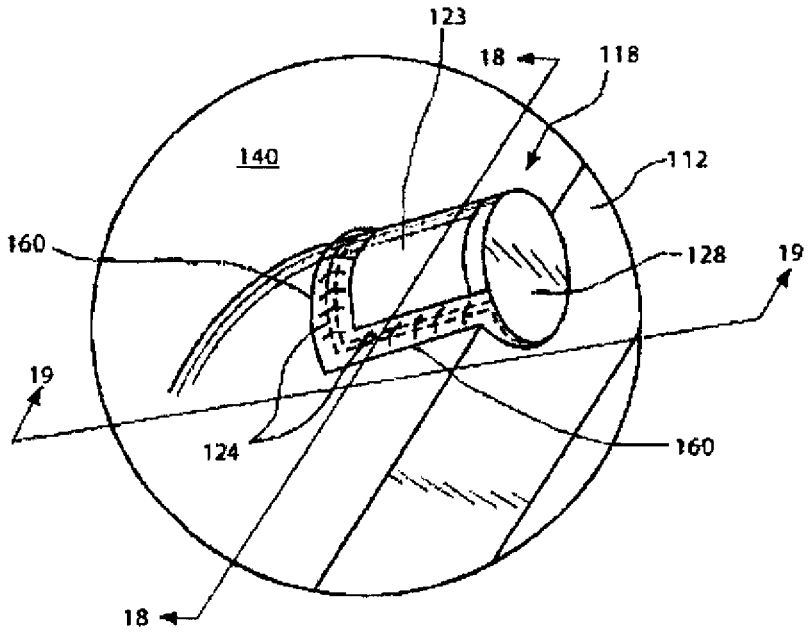

By way of example and not limitation, internal fluid passageways 119, pockets 36, and buttresses (not shown) may be machined or otherwise formed in the brown bit body 102 to form a shaped brown bit body 106 shown in FIG. 24E. Furthermore, if the drill bit 200 is to include a plurality of cutting elements integrally formed with the bit body 112, the cutting elements may be positioned within the pockets 36 formed in the brown bit body 102. Upon subsequent sintering of the brown bit body 102, the cutting elements may become bonded to and integrally formed with the bit body 112.

The shaped brown bit body 106 shown in FIG. 24E then may be fully sintered to a desired final density to provide the previously described bit body 112 shown in FIG. 20. As sintering involves densification and removal of porosity within a structure, the structure being sintered will shrink during the sintering process. A structure may experience linear shrinkage of between 10% and 20% during sintering from a green state to a desired final density. As a result, dimensional shrinkage must be considered and accounted for when designing tooling (molds, dies, etc.) or machining features in structures that are less than fully sintered.

During all sintering and partial sintering processes, refractory structures or displacements (not shown) may be used to support at least portions of a bit body during the sintering process to maintain desired shapes and dimensions during the densification process. Such displacements may be used, for example, to maintain consistency in the size and geometry of the pockets 36 and the internal fluid passageways 119 during the sintering process. Such refractory structures may be formed from, for example, graphite, silica, or alumina. The use of alumina displacements instead of graphite displacements may be desirable as alumina may be relatively less reactive than graphite, minimizing atomic diffusion during sintering. Additionally, coatings such as alumina, boron nitride, aluminum nitride, or other commercially available materials may be applied to the refractory structures to prevent carbon or other atoms in the refractory structures from diffusing into the bit body during densification.

In other methods, the green bit body 94 shown in FIG. 24B may be partially sintered to form a brown bit body without prior machining, and all necessary machining may be performed on the brown bit body prior to fully sintering the brown bit body to a desired final density. Alternatively, all necessary machining may be performed on the green bit body 94 shown in FIG. 24B, which then may be fully sintered to a desired final density.

The sintering processes described herein may include conventional sintering in a vacuum furnace, sintering in a vacuum furnace followed by a conventional hot isostatic pressing process, and sintering immediately followed by isostatic pressing at temperatures near the sintering temperature (often referred to as sinter HIP (hot isostatic pressing)). Furthermore, the sintering processes described herein may include subliquidus phase sintering. In other words, the sintering processes may be conducted at temperatures proximate to, but below the liquidus line of the phase diagram for the matrix material. For example, the sintering processes described herein may be conducted using a number of different methods known to one of ordinary skill in the art such as the Rapid Omnidirectional Compaction (ROC) process, the CERACON® process, hot isostatic pressing (HIP), or adaptations of such processes.

Broadly, and by way of example only, sintering a green powder compact using the ROC process involves presintering the green powder compact at a relatively low temperature to only a sufficient degree to develop sufficient strength to permit handling of the powder compact. The resulting brown structure is wrapped in a material such as graphite foil to seal the brown structure. The wrapped brown structure is placed in a container, which is filled with particles of a ceramic, polymer, or glass material having a substantially lower melting point than that of the matrix material in the brown structure. The container is heated to the desired sintering temperature, which is above the melting temperature of the particles of a ceramic, polymer, or glass material, but below the liquidus temperature of the matrix material in the brown structure. The heated container with the molten ceramic, polymer, or glass material (and the brown structure immersed therein) is placed in a mechanical or hydraulic press, such as a forging press, that is used to apply pressure to the molten ceramic or polymer material. Isostatic pressures within the molten ceramic, polymer, or glass material facilitate consolidation and sintering of the brown structure at the elevated temperatures within the container. The molten ceramic, polymer, or glass material acts to transmit the pressure and heat to the brown structure. In this manner, the molten ceramic, polymer, or glass acts as a pressure transmission medium through which pressure is applied to the structure during sintering. Subsequent to the release of pressure and cooling, the sintered structure is then removed from the liquefied ceramic, polymer, or glass material. A more detailed explanation of the ROC process and suitable equipment for the practice thereof is provided by U.S. Pat. Nos. 4,094,709, 4,233,720, 4,341,557, 4,526,748, 4,547,337, 4,562,990, 4,596,694, 4,597,730, 4,656,002 4,744,943 and 5,232,522, the disclosure of each of which patents is incorporated herein by reference.

The CERACON® process, which is similar to the aforementioned ROC process, may also be adapted for use in the present invention to fully sinter brown structures to a final density. In the CERACON® process, the brown structure is coated with a ceramic coating such as alumina, zirconium oxide, or chrome oxide. Other similar, hard, generally inert, protective, removable coatings may also be used. The coated brown structure is fully consolidated by transmitting at least substantially isostatic pressure to the coated brown structure using ceramic particles instead of a fluid media as in the ROC process. A more detailed explanation of the CERACON® process is provided by U.S. Pat. No. 4,499,048, the disclosure of which patent is incorporated herein by reference.

Furthermore, in embodiments of the invention in which tungsten carbide is used in a particle-matrix composite bit body, the sintering processes described herein also may include a carbon control cycle tailored to improve the stoichiometry of the tungsten carbide material. By way of example and not limitation, if the tungsten carbide material includes WC, the sintering processes described herein may include subjecting the tungsten carbide material to a gaseous mixture including hydrogen and methane at elevated temperatures. For example, the tungsten carbide material may be subjected to a flow of gases including hydrogen and methane at a temperature of about 1,000° C. A method for carbon control of carbides is provided by U.S. Pat. No. 4,579,713, the disclosure of which patent is incorporated herein by reference.

The bit body 112 is completed by attaching a shank (not shown), such as an API threaded pin mentioned above, thereto. Several different methods may be used to attach the shank to the bit body 112 and are provided by U.S. application Ser. No. 11/272,439, which is incorporated herein by reference. The bit body 112 with its particle-matrix composite materials and an abrasive wear-resistant hardfacing material attached thereon provides more resistant to the abrasive environment when drilling in subterranean formations.

While the invention has been described herein with respect to certain embodiments, those of ordinary skill in the art will recognize and appreciate that it is not so limited. Rather, many additions, deletions and modifications to the embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutting element types.

What is claimed is:

1. A rotary drill bit for drilling at least one subterranean formation, the rotary drill bit comprising:

a bit body at least substantially comprised of a pressed and sintered particle-matrix composite material and having an exposed exterior surface and a plurality of blades, the pressed and sintered particle-matrix composite material comprising a plurality of hard particles randomly dispersed throughout a matrix material, the hard particles selected from the group consisting of diamond, boron carbide, boron nitride, aluminum nitride, and carbides or borides of the group consisting of W, Ti, Mo, Nb, V, Hf, Zr, and Cr, the matrix material selected from the group consisting of cobalt-based alloys, iron-based alloys, nickel-based alloys, cobalt- and nickel-based alloys, iron- and nickel-based alloys, iron- and cobalt-based alloys, and titanium-based alloys; and an abrasive wear-resistant material disposed in at least one recess extending into a formation-engaging surface of at least one blade of the plurality of blades and extending longitudinally along an edge of the at least one blade defined by the intersection between two surfaces comprising a portion of an exposed exterior surface of the bit body, an exposed surface of the abrasive wear-resistant material being at least substantially level with the exposed exterior surface of the bit body adjacent the abrasive wear-resistant material taken in a direction generally perpendicular to the exposed exterior surface of the bit body adjacent the abrasive wear-resistant material, wherein the abrasive wear-resistant material disposed in at least one recess extending into the bit body comprises the following materials in pre-application ratios:

a matrix material, the matrix material comprising between about 20% and about 50% by weight of the abrasive wear-resistant material, the matrix material comprising at least 75% nickel by weight, the matrix material having a melting point of less than about 1100°C.;

a plurality of −10 ASTM mesh sintered tungsten carbide pellets substantially randomly dispersed throughout the matrix material, the plurality of sintered tungsten carbide pellets comprising between about 30% and about 55% by weight of the abrasive wear-resistant material, each sintered tungsten carbide pellet comprising a plurality of tungsten carbide particles bonded together with a binder alloy, the binder alloy having a melting point greater than about 1200°C; and a plurality of −18 ASTM mesh cast tungsten carbide granules substantially randomly dispersed throughout the matrix material, the plurality of cast tungsten carbide granules comprising less than about 35% by weight of the abrasive wear-resistant material.

2. The rotary drill bit of claim 1, further comprising:

a shank attached directly to the bit body, the shank comprising a portion configured to attach the shank to a drill string.

3. The rotary drill bit of claim 2, wherein the bit body is configured to carry a plurality of cutting elements, and the material composition of the pressed and sintered particle-matrix composite material varies within the bit body.

4. The rotary drill bit of claim 1, further comprising:

at least one cutting element secured to the bit body along an interface; and a brazing alloy disposed between the bit body and the at least one cutting element at the interface, the brazing alloy securing the at least one cutting element to the bit body, at least a continuous portion of another abrasive wear-resistant material having the same composition as the abrasive wear-resistant material disposed in the at least one recess, the another abrasive wear-resistant material being bonded to an exterior surface of the bit body and a surface of the at least one cutting element and extending over the interface between the bit body and the at least one cutting element and covering at least a portion of the brazing alloy.

5. The rotary drill bit of claim 4, wherein the bit body comprises a pocket in the exterior surface of the bit body, at least a portion of the at least one cutting element being disposed within the pocket, the interface extending along adjacent surfaces of the bit body and the at least one cutting element, and wherein the at least one recess extending into the bit body comprises at least one recess formed in the exterior surface of the bit body adjacent the interface.

6. The rotary drill bit of claim 4, wherein the at least one cutting element comprises a cutting element body and a polycrystalline diamond compact table secured to an end of the cutting element body.

7. The rotary drill bit of claim 1, wherein the plurality of −10 ASTM mesh sintered tungsten carbide pellets comprises a plurality of −60/+80 ASTM mesh sintered tungsten carbide pellets, and wherein the plurality of −18 ASTM mesh cast tungsten carbide granules comprises a plurality of −100/+270 ASTM mesh cast tungsten carbide granules.

8. The rotary drill bit of claim 1, wherein the plurality of −10 ASTM mesh sintered tungsten carbide pellets comprises a plurality of −60/+80 ASTM mesh sintered tungsten carbide pellets and a plurality of −120/+270 ASTM mesh sintered tungsten carbide pellets, the plurality of −60/+80 ASTM mesh sintered tungsten carbide pellets comprising between about 30% and about 35% by weight of the abrasive wear-resistant material, the plurality of −120/+270 ASTM mesh sintered tungsten carbide pellets comprising between about 10% and about 20% by weight of the abrasive wear-resistant material.

* * * * *

UNITED STATES PATENT AND TRADEMARK OFFICE

CERTIFICATE OF CORRECTION

PATENT NO. : 8,002,052 B2
APPLICATION NO. : 11/823800
DATED : August 23, 2011
INVENTOR(S) : John H. Stevens et al.

It is certified that error appears in the above-identified patent and that said Letters Patent is hereby corrected as shown below:

On the title page:

Related U.S. Application Data

| | | |
|---|---|---|
| In ITEM (63) | 2nd line (line 31) | change "Aug. 30, 2006," to --Aug. 30, 2006, now Pat. No. 7,703,555,-- |
| | 3rd line (line 32) | change "Nov. 10, 2005," to --Nov. 10, 2005, now Pat. No. 7,776,256,-- |
| | 5th line (line 34) | change "Sep. 9, 2005." to --Sep. 9, 2005, now Pat. No. 7,597,159.-- |

In the drawings:

Replace Fig. 17 with the attached amended figure

| | |
|---|---|
| In FIG. 17 | change reference numeral "116" to --124-- |

In the specification:

| | | |
|---|---|---|
| COLUMN 7, | LINE 46, | change "is and configured" to --is configured-- |
| COLUMN 9, | LINE 10, | change "wear-resistant" to --abrasive wear-resistant-- |
| COLUMN 9, | LINE 12, | change "wear-resistant" to --abrasive wear-resistant-- |
| COLUMN 10, | LINE 46, | change "alloy may" to --alloy that may-- |
| COLUMN 11, | LINE 10, | change "pockets provided" to --pockets **122** provided-- |
| COLUMN 11, | LINE 44, | change "the a polycrystalline" to --the polycrystalline-- |
| COLUMN 12, | LINE 45, | change "iron-and" to --iron- and-- |
| COLUMN 12, | LINE 45, | change "cobalt-and" to --cobalt- and-- |
| COLUMN 12, | LINE 46, | change "iron-and" to --iron- and-- |
| COLUMN 13, | LINES 30,31 | change "carbide pellets **58**" to --carbide granules **58**-- |
| COLUMN 13, | LINE 35, | change "carbide pellets **58**" to --carbide granules **58**-- |

Signed and Sealed this
Third Day of February, 2015

Michelle K. Lee

Michelle K. Lee
*Deputy Director of the United States Patent and Trademark Office*

In the specification (cont.):

| | | |
|---|---|---|
| COLUMN 14, | LINE 1, | change “carbide pellets” to --carbide pellets **56**-- |
| COLUMN 16, | LINE 2, | change “nickel base” to --nickel-based-- |
| COLUMN 16, | LINE 5, | change “material **56**,” to --material,-- |
| COLUMN 16, | LINE 6, | change “carbide pellets” to --carbide pellets **56**-- |
| COLUMN 16, | LINE 9, | change “carbide pellets” to --carbide pellets **56**-- |
| COLUMN 16, | LINE 10, | change “of 89-91” to --of about 89-91-- |
| COLUMN 16, | LINE 13, | change “usually allows” to --usually allow-- |
| COLUMN 16, | LINES 13,14 | change “carbide pellets” to --carbide pellets **56**-- |
| COLUMN 16, | LINE 16, | change “carbide pellets” to --carbide pellets **56**-- |
| COLUMN 17, | LINE 50, | change “heat to the” to --heat the-- |
| COLUMN 19, | LINE 26, | change “iron-and” to --iron- and-- |
| COLUMN 19, | LINE 26, | change “cobalt-and” to --cobalt- and-- |
| COLUMN 19, | LINE 27, | change “iron-and” to --iron- and-- |
| COLUMN 19, | LINE 34, | change “iron-or” to --iron- or-- |
| COLUMN 19, | LINE 37, | change “alloys” to --alloy-- |
| COLUMN 23, | LINE 57, | change “resistant” to --resistance-- |